US007251444B2

(12) United States Patent
Matsuda et al.

(10) Patent No.: US 7,251,444 B2
(45) Date of Patent: Jul. 31, 2007

(54) APPARATUS FOR CONTROLLING DRIVING OF ENDLESS BELT, AND IMAGE FORMING APPARATUS

(75) Inventors: Yuji Matsuda, Tokyo (JP); Hiromichi Matsuda, Kanagawa (JP); Toshiyuki Andoh, Kanagawa (JP); Nobuto Yokokawa, Saitama (JP); Ryoji Imai, Kanagawa (JP); Hiroshi Okamura, Kanagawa (JP); Masato Yokoyama, Kanagawa (JP); Kazuhiko Kobayashi, Tokyo (JP); Yohei Miura, Chiba (JP)

(73) Assignee: Ricoh Company, Ltd., Tokyo (JP)

( * ) Notice: Subject to any disclaimer, the term of this patent is extended or adjusted under 35 U.S.C. 154(b) by 192 days.

(21) Appl. No.: 11/203,309

(22) Filed: Aug. 15, 2005

(65) Prior Publication Data

US 2006/0110189 A1 May 25, 2006

(30) Foreign Application Priority Data

Aug. 17, 2004 (JP) ..... 2004-237113
Dec. 28, 2004 (JP) ..... 2004-378545

(51) Int. Cl.
*G03G 15/01* (2006.01)
*G03G 15/00* (2006.01)

(52) U.S. Cl. ..... 399/301; 399/167; 399/302

(58) Field of Classification Search ..... 399/167, 399/299, 301, 302, 303; 347/116
See application file for complete search history.

(56) References Cited

U.S. PATENT DOCUMENTS 6,038,423 A 3/2000 Tagawa et al.
6,626,101 B2 * 9/2003 Kajiwara et al. ..... 101/171
6,661,981 B2 * 12/2003 Boothe et al. ..... 399/44
6,771,919 B2 * 8/2004 Koide ..... 399/167
2004/0164691 A1 8/2004 Andoh et al.
2005/0053388 A1 3/2005 Yokoyama et al.
2005/0057209 A1 3/2005 Andoh et al.
2005/0085945 A1 4/2005 Andoh et al.
2006/0110189 A1 5/2006 Matsuda et al.

FOREIGN PATENT DOCUMENTS

EP 1 031 887 A2 8/2000
JP 8-234531 9/1996
JP 10-186787 7/1998
JP 2000-310897 11/2000
JP 2001-16883 1/2001

OTHER PUBLICATIONS

U.S. Appl. No. 11/558,645, filed Nov. 10, 2006, Takahashi, et al.
U.S. Appl. No. 11/335,657, filed Jan. 20, 2006, Okamura, et al.

* cited by examiner

*Primary Examiner*—Hoang Ngo
(74) *Attorney, Agent, or Firm*—Oblon, Spivak, McClelland, Maier & Neustadt, P.C.

(57) ABSTRACT

To compensate for the variation in the output signal from an encoder due to the variation in the thickness of an endless belt, an apparatus includes: a detector that detects a reference position on the endless belt; a correction-value calculating unit that calculates a correction value for each position on the endless belt based on the thickness; and a target-value calculating unit that adjusts a target value for controlling a driving motor based on the correction value corresponding to a distance from the reference position to the current position.

27 Claims, 17 Drawing Sheets

| COEFFICIENT | VALUE |
|---|---|
| a11= | 8173 |
| a21= | −2225 |
| b01= | 133 |
| b11= | 266 |
| b21= | 133 |
| a12= | 10389 |
| a22= | −5050 |
| b02= | 11022 |
| b12= | 22045 |
| b22= | 11022 |

| | |
|---|---|
| ISF | 2240 |
| qformat | 13 |

PHASE DIFFERENCE $\tau$ (ASSUMING THAT FULL CIRCLE OF BELT HAS $2\pi$)

APPARATUS FOR CONTROLLING DRIVING OF ENDLESS BELT, AND IMAGE FORMING APPARATUS

CROSS-REFERENCE TO RELATED APPLICATIONS

The present document incorporates by reference the entire contents of Japanese priority document, 2004-237113 filed in Japan on Aug. 17, 2004 and 2004-378545 filed in Japan on Dec. 28, 2004 .

BACKGROUND OF THE INVENTION

1. Field of the Invention

The present invention relates to an apparatus for controlling a driving of an endless belt included in a color image forming apparatus to keep a linear velocity of the endless belt constant.

2. Description of the Related Art

As representative methods of forming a color image, there are a direct transfer system for transferring toner images of different colors formed on plural photoconductors directly onto transfer paper by superimposing the toner images, and an intermediate transfer system for transferring toner images of different colors formed on plural photoconductors onto an intermediate transfer unit by superimposing the toner images and thereafter collectively transferring the toner images onto transfer paper. These systems are called a tandem system since plural photoconductors are disposed opposite to the transfer paper or the intermediate transfer unit. An electrophotographic process of a formation of an electrostatic latent image and a development is carried out for each of yellow (Y), magenta (M), cyan (C), and black (K) colors for each photoconductor. According to the direct transfer system, toner images are transferred onto running transfer paper. According to the intermediate transfer system, toner images are transferred onto a running intermediate transfer unit.

A color image forming apparatus of the tandem system using the direct transfer system usually uses an endless belt that runs while supporting the transfer paper. A color image forming apparatus of the tandem system using the intermediate transfer system usually uses an endless belt that receives images from photoconductors and holds these images. Image forming units including four photoconductors are disposed on one running side of the belt. In the color image forming apparatus of the tandem system, superimposing the toner images of different colors in high precision is important for preventing a color drift. In both the transfer systems, to avoid a color drift due to a variation in the speed of the transfer conveyer belt, an encoder is fitted to one of driven axes of plural transfer units, and a rotation speed of a driving roller is feedback controlled according to the variation in the rotation speed of the encoder, as effective control means.

As one of the most general methods of realizing the feedback control, there is a proportional and integral control (PI control). According to the method, a position deviation e(n) is calculated based on a difference between a target angular displacement Ref(n) of the encoder and a detection angular displacement P(n−1) detected by the encoder. The result of the above calculation is lowpass filtered to remove high-frequency noise. A control gain is applied, and a constant standard driving pulse frequency is added, thereby controlling the driving pulse frequency of a driving motor connected to a driving roller. As a result, the encoder is always driven at a target angular displacement.

In the actual control, a counter that counts a rising edge of the output of an encoder pulse and a counter that counts each control period (for example, 1 millisecond) are used to obtain a position deviation from a difference between a calculation result of a target angular displacement that moves during the control period (1 millisecond) and a detection angular displacement that is obtained by acquiring the encoder count value during each control period. When a roller diameter of the driven axis to which the encoder is fitted is ϕ15.615, a detailed calculation is carried out as follows:

$$e(n)=\theta_0\times q-\theta_1\times ne,$$

where e(n) [rad]: A position deviation (calculated at the sampling this time);

$\theta_0$ [rad]: A move angle per control period ($=2\pi\times V\times 10^{-3}/15.565\pi$ [rad]);

$\theta_1$ [rad]: A move angle per one pulse of encoder ($=2\pi/p$ [rad]);

q: A count value of control period timer; and

V: A belt linear velocity [mm/s].

Assume that a control period is 1 millisecond, and resolution of the encoder is 300 pulses per one rotation. A feedback control is carried out to operate the transfer conveyer belt at 162 mm/s. Then the move angles are obtained as follows:

$$\theta_0=2\pi\times 162\times 10-3/15.615\pi=0.0207487 \text{ [rad]; and}$$

$$\theta_1=2\pi/p=2\pi/300=0.0209439 \text{ [rad].}$$

The above calculation is carried out for each control period to obtain position deviations, thereby carrying out the feedback control.

The above method, however, has the following problems. The conveyance speed of the transfer paper changes due to a fine thickness of the conveyer belt. As a result, an image is deviated from an ideal position, which degrades the image quality. Images among plural sheets of recording papers vary, and repetitive positional reproducibility among the recording papers is degraded. When it is assumed that the conveyance speed is determined at the center of the belt thickness at the belt driving position, a belt conveyance speed V is calculated as follows:

$$V=(R+B/2)\times\omega,$$

where

R: Radius of the driving roller;

B: Thickness of the belt; and

ω: Angular velocity of the driving roller.

However, when a belt thickness B varies, a position of a belt thickness effective line shown in FIG. 21 changes. This is because a belt driving effective radius changes. It is clear that since (R+B/2) in the above expression changes, the belt conveyance speed changes even when angular velocity ω of the driving roller is constant. In other words, even when the driving roller is rotated at a constant angular velocity, the belt conveyance speed changes when the belt thickness varies.

FIG. 22 depicts a model of a belt driving conveyance system. FIG. 23 is a conceptual diagram of a variation in the belt thickness over full circle of the belt when the driving axis is rotated at a constant angular velocity and a variation in the belt conveyance speed. When a thick part of the belt is wound around the driving axis, a belt driving effective radius shown in FIG. 21 increases, and the belt conveyance speed increases. On the other hand, when a thin part of the belt is wound around the driving axis, the belt conveyance speed decreases.

FIG. 24 is a diagram for explaining a variation in the belt thickness on the driven axis and a variation in the belt conveyance speed detected in the driven axis when the belt is conveyed at a constant conveyance speed. Even when the belt is conveyed at an ideal speed without a speed variation, when a thick part of the belt is wound around the driven axis, a driven effective radius of the belt increases, and a rotation angular velocity of the driven axis decreases. This is detected as a decrease in the belt conveyance speed. When a thin part of the belt is wound around the driven axis, the rotation angular velocity of the driven axis increases, and this is detected as an increase in the belt conveyance speed. When the belt thickness varies in this manner, when a belt conveyance speed is detected in the rotation angular displacement of the driven axis in the encoder, an error detection component is generated. Therefore, even when the belt is conveyed at a constant speed, the belt conveyance speed is detected as if the speed is varying due to the variation in the belt thickness, in the detection of the rotation angular displacement of the driven axis. Therefore, according to the conventional feedback control of the driven axis, the variation in the belt thickness cannot be controlled.

As one of methods for solving the variation in the belt thickness, the following technique is known. When a driving roller is driven at a constant pulse rate, a speed profile that offsets a speed variation Vh that will occur due to a thickness profile over the whole peripheral direction of a known transfer conveyer belt is measured in advance, based on a position detected according to a belt mark. A driving motor control signal is generated at a modulated pulse rate. The motor is driven based on the generated signal. By driving the transfer conveyer belt via the driving roller, a final speed Vb of the transfer conveyer belt has no variation (see, for example, Japanese Patent Application Laid-Open No. 2000-310897).

However, speed profile data requires data for each control period. Therefore, when the control is carried out in a short period, a large capacity memory is necessary. When the control is carried out in a long period, sufficient effect cannot be obtained from the feedback control. When a belt length is 815 millimeters, when a belt driving speed is 125 mm/s, and when a control period is 1 millisecond, the belt speed is controlled by 6,520 times per one rotation of the belt as follows:

$$815\ \text{mm}/(125\ \text{mm}/s \times 1\ \text{ms}) = 6520\ \text{times}.$$

When a data size of the belt thickness per one point is expressed by 16 bits, a memory of 100 kilobits or more is necessary.

$$6520\ \text{times} \times 16\ \text{bit} = 104320\ \text{bit}$$

Therefore, when the control is carried out using an actual device, a memory for storing a belt thickness profile is additionally necessary as a nonvolatile memory. Even when data is stored as compressed data and when the data is uncompressed in a volatile memory when the power source is turned on, a large capacity memory is necessary. Therefore, in addition to a memory used as a normal work area, a separate memory is necessary, which is unrealistic since the cost is substantially increased.

According to Japanese Patent Application Laid-Open No. 2000-310897, the belt thickness needs to be measured as profile data of the belt thickness. The thickness is measured with a laser displacement measuring device. The measured data is input at a product shipment time or by service personnel with an input unit such as an operation panel. However, to measure a variation in the belt thickness of a few micrometers, a high-precision measuring unit is necessary. Furthermore, since data management amount of the measured result and the data amount are large, input errors can occur.

SUMMARY OF THE INVENTION

It is an object of the present invention to at least solve the problems in the conventional technology.

An apparatus according to an aspect of the present invention controls a driving motor that drives a driving roller based on an output signal from an encoder attached to a driven roller. The apparatus includes: an endless belt that is driven by the driving roller, the endless belt bearing a mark indicating a reference position and having a thickness of which variation is represented by a function of a phase, a maximum amplitude, and a period; a reference-position detector that detects the reference position by detecting the mark; a nonvolatile memory that stores the phase at the reference position, the maximum amplitude, and the period; a correction-value calculating unit that calculates a correction value for a position on the endless belt based on a thickness of the endless belt at the position, the thickness being determined by the phase, the maximum amplitude, and the period; a volatile memory that stores the correction value calculated; and a target-value calculating unit that reads out a correction value for a current position from the volatile memory based on a distance from the reference position to the current position, and adjusts a target value for controlling the driving motor based on the correction value to compensate for a variation in the output signal from the encoder due to the variation in the thickness of the endless belt.

An apparatus according to another aspect of the present invention controls a driving motor that drives a driving roller based on an output signal from an encoder attached to a driven roller so that an angular velocity of the encoder is kept at a target value. The apparatus includes: an endless belt that is driven by the driving roller, the endless belt bearing a mark indicating a reference position and having a thickness of which variation is represented by a function of a phase and a maximum amplitude; a reference-position detector that detects the reference position by detecting the mark; an angular-velocity-variation detecting unit that detects a variation in the angular velocity of the encoder due to the variation in the thickness of the endless belt; a parameter calculating unit that determines the phase at the reference position and the maximum amplitude based on the variation in the angular velocity of the encoder; a nonvolatile memory that stores the phase at the reference position and the maximum amplitude; a correction-value calculating unit that calculates a correction value for a position on the endless belt based on a thickness of the endless belt at the position, the thickness being determined by the phase at the reference position and the maximum amplitude; a volatile memory that stores the correction value calculated; and a target-value calculating unit that reads out a correction value for a current position from the volatile memory based on a distance from the reference position to the current position, and adjusts the target value based on the correction value to compensate for a variation in the output signal from the encoder due to the variation in the thickness of the endless belt.

An image forming apparatus according to still another aspect of the present invention includes a driving motor that drives a driving roller based on an output signal from an encoder attached to a driven roller. The image forming apparatus further includes: an endless belt that is driven by the driving roller, the endless belt bearing a mark indicating a reference position and having a thickness of which variation is represented by a function of a phase, a maximum amplitude, and a period; a reference-position detector that detects the reference position by detecting the mark; a nonvolatile memory that stores the phase at the reference position, the maximum amplitude, and the period; a correction-value calculating unit that calculates a correction value for a position on the endless belt based on a thickness of the endless belt at the position, the thickness being determined by the phase, the maximum amplitude, and the period; a volatile memory that stores the correction value calculated; and a target-value calculating unit that reads out a correction value for a current position from the volatile memory based on a distance from the reference position to the current position, and adjusts a target value for controlling the driving motor based on the correction value to compensate for a variation in the output signal from the encoder due to the variation in the thickness of the endless belt.

An image forming apparatus according to still another aspect of the present invention controls a driving motor that drives a driving roller based on an output signal from an encoder attached to a driven roller so that an angular velocity of the encoder is kept at a target value. The image forming apparatus includes: an endless belt that is driven by the driving roller, the endless belt bearing a mark indicating a reference position and having a thickness of which variation is represented by a function of a phase and a maximum amplitude; a reference-position detector that detects the reference position by detecting the mark; an angular-velocity-variation detecting unit that detects a variation in the angular velocity of the encoder due to the variation in the thickness of the endless belt; a parameter calculating unit that determines the phase at the reference position and the maximum amplitude based on the variation in the angular velocity of the encoder; a nonvolatile memory that stores the phase at the reference position and the maximum amplitude; a correction-value calculating unit that calculates a correction value for a position on the endless belt based on a thickness of the endless belt at the position, the thickness being determined by the phase at the reference position and the maximum amplitude; a volatile memory that stores the correction value calculated; and a target-value calculating unit that reads out a correction value for a current position from the volatile memory based on a distance from the reference position to the current position, and adjusts the target value based on the correction value to compensate for a variation in the output signal from the encoder due to the variation in the thickness of the endless belt.

The other objects, features, and advantages of the present invention are specifically set forth in or will become apparent from the following detailed description of the invention when read in conjunction with the accompanying drawings.

DETAILED DESCRIPTION OF THE PREFERRED EMBODIMENTS

Exemplary embodiments of the present invention will be explained in detail below with reference to the accompanying drawings.

Figure 1:
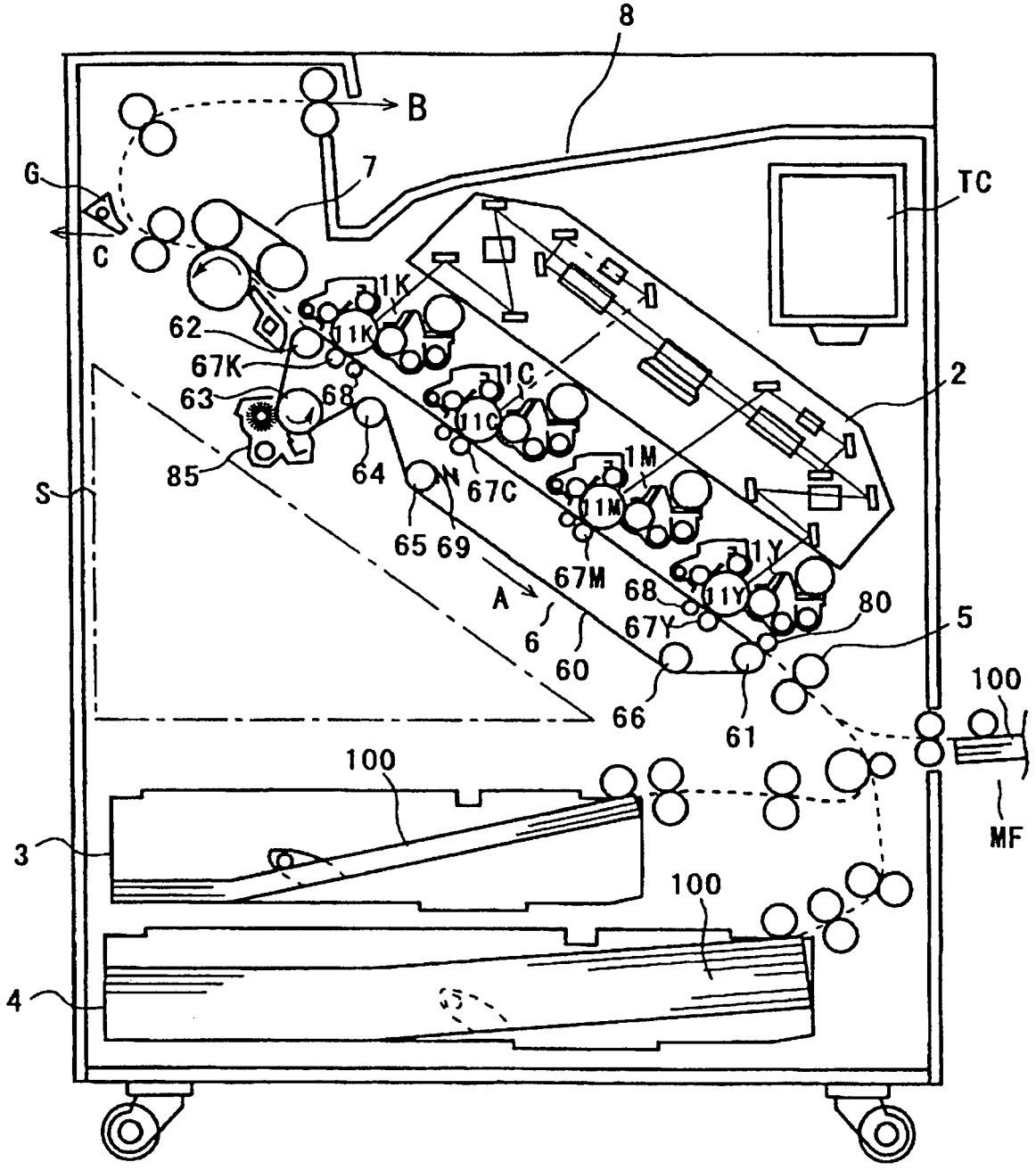
FIG. 1 is a diagram for explaining a configuration of an image forming apparatus according to an embodiment of the present invention.

FIG. 1 is a diagram for explaining a configuration of an image forming apparatus according to an embodiment of the present invention. Specifically, the image forming apparatus is a color laser printer (hereinafter, "laser printer") adopting a direct transfer system and an electrophotographing system. In the laser printer, four toner image forming units 1Y, 1M, 1C, and 1K (hereinafter, the subscripts Y, M, C, and K denote yellow, magenta, cyan, and black color members, respectively) that form images of yellow (Y), magenta (M), cyan (C), and black (K) are sequentially disposed in a moving direction of a transfer paper 100 (direction in which a transfer conveyer belt 60 runs in an arrow A direction in FIG. 1) from the upstream. The toner image forming units 1Y, 1M, 1C, and 1K have photoconductive drums 11Y, 11M, 11C, and 11K as image carriers, and developing units. The toner image forming units 1Y, 1M, 1C, and 1K are disposed so that rotation axes of the photoconductive drums are in parallel and that the toner image forming units are disposed at predetermined pitches in the moving direction of the transfer paper.

The laser printer includes an optical writing unit 2, paper feed cassettes 3 and 4, a pair of resist rollers 5, a transfer unit 6 as a belt driving device having the transfer conveyer belt 60 as a transfer conveyer member that holds and conveys the transfer paper 100 to pass through transfer positions of toner image forming units, a fixing unit 7 of a belt fixing system, a paper ejection tray 8, and the like in addition to the toner image forming units 1Y, 1M, 1C, and 1K. The laser printer also includes a manual paper feed tray MF, and a toner replenishment container TC, and also has a waste toner bottle, a double-side inverting unit, a power source unit, and the like (not shown) in a space S indicated by a chain double-dashed line.

The optical writing unit 2 has a light source, a polygon mirror, an fθ lens, a reflection mirror, and the like and irradiates a laser beam while scanning the surfaces of the photoconductive drums 11Y, 11M, 11C, and 11K based on the image data.

Figure 2:
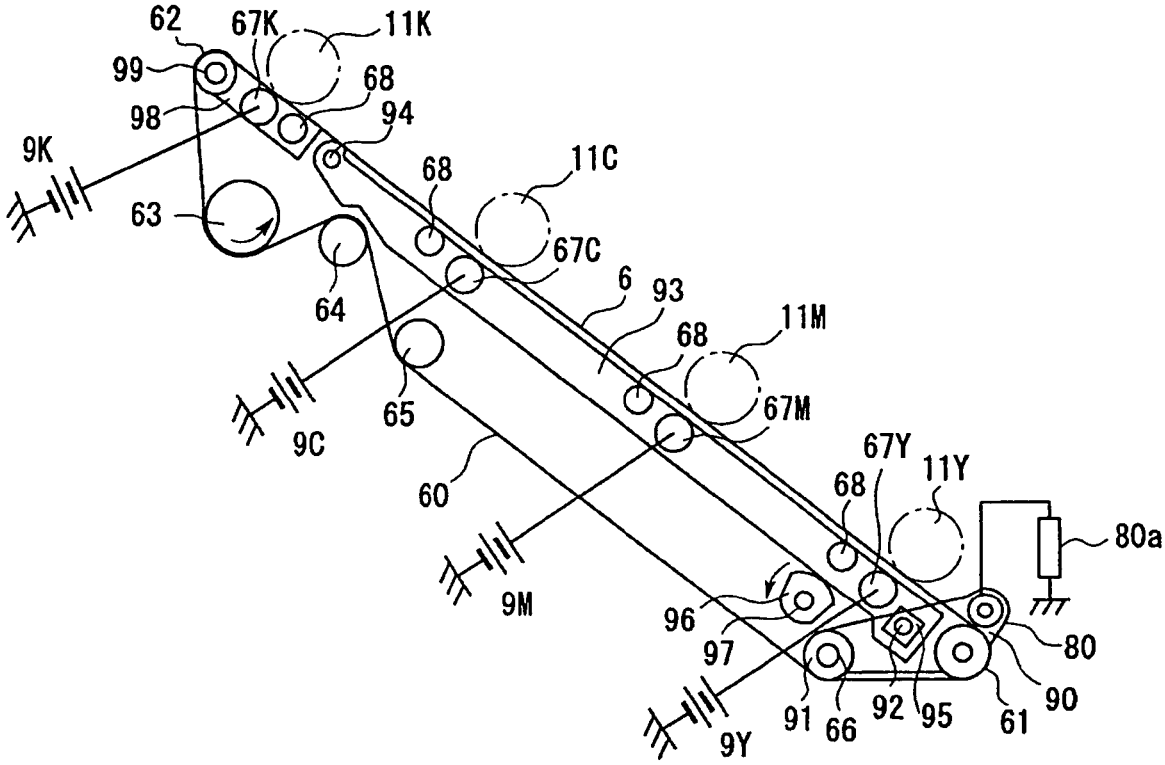
FIG. 2 is a diagram for explaining a configuration of a transfer unit shown in FIG. 1.

FIG. 2 is an enlarged diagram for explaining a configuration of the transfer unit 6. The transfer conveyer belt 60 (endless belt) used in the transfer unit 6 is a high-resistance endless single-layer belt having a volume resistance rate of $10^9$ to $10^{11}$ Ωcm. The transfer conveyer belt 60 is made of polyvinylidene fluoride (PVDF). The transfer conveyer belt 60 is hooked around supporting rollers 61 to 68 so as to pass through the transfer positions facing and in contact with the photoconductive drums 11Y, 11M, 11C, and 11K of the toner image forming units.

Among these supporting rollers, on an entrance roller 61 at the upstream of the transfer paper moving direction, an electrostatic attraction roller 80 applied with a predetermined voltage from a power source 65*a* is disposed on the external peripheral surface of the transfer conveyer belt 60 to face the entrance roller 61. The transfer paper 100 that passes through between the two rollers 61 and 65 is electrostatically attracted on the transfer conveyer belt 60. A driving roller 63 is a driving roller that frictionally drives the transfer conveyer belt 60, rotates in an arrow direction, and is connected to a driving source (not shown).

At positions opposite to the photoconductive drums 11Y, 11M, 11C, and 11K, transfer bias applying members 67Y, 67M, 67C, and 67K are provided so as to be in contact with the back surface of the transfer conveyer belt 60, as a transfer electric field forming unit that forms a transfer electric field at each transfer position. These are bias rollers on the external surfaces of which sponge or the like is provided. A transfer bias is applied to a roller core metal from each of transfer bias power sources 9Y, 9M, 9C, and 9K. A transfer charge is applied to the transfer conveyer belt 60 based on the work of the applied transfer bias. A transfer electric field of predetermined intensity is formed between the transfer conveyer belt 60 and the surfaces of the photoconductive drums 11Y, 11M, 11C, and 11K at each transfer position. A backup roller 68 is also provided to maintain a proper contact between the transfer paper and the photoconductive drums 11Y, 11M, 11C, and 11K and to obtain a best transfer nip in the transfer area.

The transfer bias applying members 67Y, 67M, and 67C and the backup roller 68 disposed near these members are rotatably and integrally held on an oscillation bracket 93, and can be rotated around a rotation axis 94. This rotation is in a clockwise rotation based on the rotation of a cam 96 fixed to a cam axis 97 in an arrow direction.

The entrance roller 61 and the electrostatic attraction roller 80 are integrally supported by an entrance roller bracket 90, and can be rotated in a clockwise direction in a state shown in FIG. 2 around an axis 91. A hole 95 formed on the oscillation bracket 93 and a pin 92 fixed to the entrance roller bracket 90 are engaged together, and rotate together with the rotation of the oscillation bracket 93. Based on the clockwise rotation of the brackets 90 and 93, the transfer bias applying members 67Y, 67M, and 67C and the backup roller 68 disposed near these members are separated from the photoconductive drums 11Y, 11M, and 11C, and the entrance roller 61 and the electrostatic attraction roller 80 move downward. At the time of forming an image of black only, a contact between the photoconductive drums 11Y, 11M, and 11C and the transfer conveyer belt 60 can be avoided.

On the other hand, the transfer bias applying member 67K and the backup roller 68 adjacent to this member are rotatably supported by an exit bracket 98, and can rotate around an axis 99 coaxial with an exit roller 62. In detaching the transfer unit 6 from the main unit, the transfer unit 6 is rotated in the clockwise direction using a handle (not shown). With this arrangement, the transfer bias applying member 67K and the backup roller 68 adjacent to this member are separated from the photoconductive drum 11K for forming a black image.

A cleaning device 85 including a brush roller and a cleaning blade is brought into contact with the external peripheral surface of the transfer conveyer belt 60 wound around the driving roller 63. The cleaning device 85 removes foreign matters such as a toner that is adhered to the transfer conveyer belt 60.

A roller 64 is provided in a direction to push the external peripheral surface of the transfer conveyer belt 60, at the downstream of the driving roller 63 in the running direction of the transfer conveyer belt 60, thereby securing a winding angle to the driving roller 63. A tension roller 65 that applies a tension to the belt with a pressing member (spring) 69 is provided within a loop of the transfer conveyer belt 60 at further downstream of the roller 64.

A dashed line shown in FIG. 1 indicates a conveyance route of the transfer paper 100. The transfer paper 100 fed from the paper feed cassettes 3 and 4 or the manual paper feed tray MF is conveyed with a conveyer roller while being guided by a conveyance guide (not shown), and is sent to a temporary stop position where the pair of resist rollers 5 are provided. The transfer paper 100 that is sent at a predetermined timing by the pair of resist rollers 5 is held on the transfer conveyer belt 60, conveyed toward the toner image forming units 1Y, 1M, 1C, and 1K, and passes through each transfer nip.

Toner images developed on the photoconductive drums 11Y, 11M, 11C, and 11K of the toner image forming units 1Y, 1M, 1C, and 1K are superimposed on the transfer paper 100 at the respective transfer nips, and are transferred onto the transfer paper 100 by receiving the transfer electric field and nip pressures. A full-color toner image is formed on the transfer paper 100 based on the superimposed transfer. The cleaning device cleans the surfaces of the photoconductive drums 11Y, 11M, 11C, and 11K after the transfer of the toner images. Electricity is removed from these photoconductive drums, to prepare for the next formation of electrostatic latent images.

On the other hand, the fixing unit 7 fixes the full-color toner image formed on the transfer paper 100. The transfer paper 100 is directed to a first paper eject direction B or a second paper eject direction C corresponding to a rotation posture of a switching guide G. When the transfer paper 100 is ejected onto the paper ejection tray 8 from the first paper eject direction B, the transfer paper 100 is stacked in what is called a face-down state with the image surface facing downward. On the other hand, when the transfer paper 100 is ejected in the second paper eject direction C, the transfer paper 100 is conveyed toward a separate post-processing device (such as a sorter, or a binder) (not shown), or is conveyed to the pair of resist rollers 5 again to print on both sides via a switch back unit.

A full-color image is formed on the transfer paper 100 based on the above configuration. In the color image forming apparatus of the tandem system, it is important to superimpose toner images of various colors in high precision to prevent a color drift. However, the driving roller 63, the entrance roller 61, the exit roller 62, and the transfer conveyer belt 60 that are used in the transfer unit 6 have a manufacturing error of a few dozens of micrometers when parts are manufactured. Due to this error, a variation component that occurs when each part makes one rotation is transmitted to the transfer conveyer belt 60, and the paper conveyance speed varies. As a result, a slight deviation occurs in the timing when the toners on the photoconductive drums 11Y, 11M, 11C, and 11K are transferred onto the transfer paper 100, and a color drift occurs in the sub-scan direction. Particularly, in the apparatus that forms an image in fine dots of 1200×1200 dots per inch or the like, as in the present embodiment, timing deviation of a few micrometers leads to a distinguishable color drift. According to the present embodiment, an encoder is provided on the axis of a right lower roller 66. By detecting a rotation speed of the encoder, the rotation of the driving roller 63 is feedback controlled, thereby making the transfer conveyer belt 60 run at a constant speed.

Figure 3:
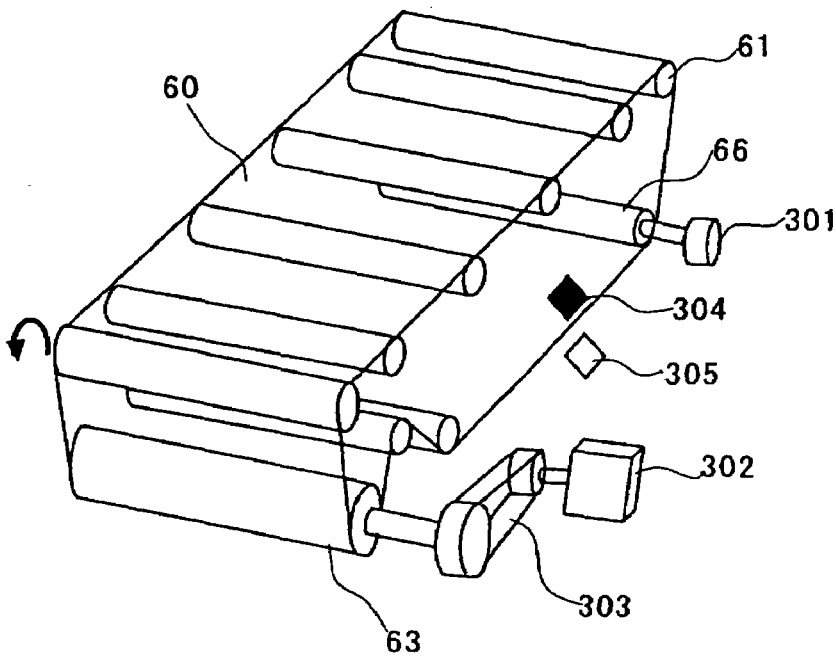
FIG. 3 is a diagram for explaining a configuration of relevant parts of the transfer unit shown in FIG. 1.

FIG. 3 is a diagram for explaining a configuration of relevant parts of the transfer unit 6. The driving roller 63 is connected to a driving gear of a transfer driving motor 302 through a timing belt 303. When the transfer driving motor 302 is driven, the driving roller 63 is rotated in proportion to the driving speed of the transfer driving motor 302. When the driving roller 63 is rotated, the transfer conveyer belt 60 is driven, by which the right lower roller 66 is rotated. In the present embodiment, an encoder 301 is disposed on the axis of the right lower roller 66. The encoder 301 detects the rotation speed of the right lower roller 66, thereby controlling the speed of the transfer driving motor 302. Since a color drift occurs due to the variation in the speed of the transfer conveyer belt 60 as described above, this speed control minimizes the speed variation.

Figure 4:
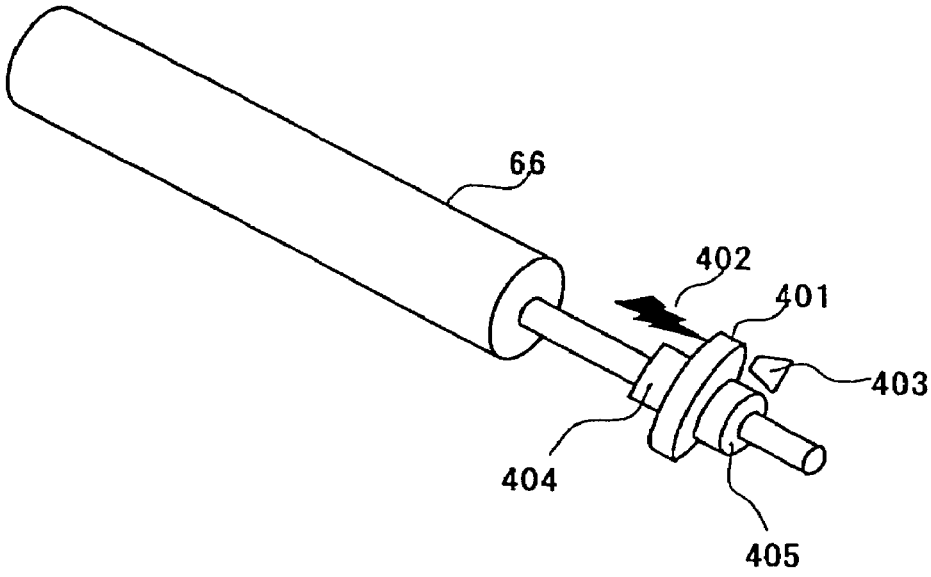
FIG. 4 is a diagram for explaining a detailed configuration of a right lower roller and an encoder shown in FIG. 3.

FIG. 4 is a detailed diagram of the right lower roller 66 and the encoder 301. The encoder 301 includes a disk 401, a light-emitting element 402, a light-receiving element 403, and pressing bushes 404 and 405. The disk 401 is fixed to the axis of the right lower roller 66 by pressing the pressing bushes 404 and 405 to the axis of the right lower roller 66. The disk 401 rotates together with the rotation of the right lower roller 66. The disk 401 has slits that pass light in the resolution of a few hundred units in the circumferential direction. The light-emitting element 402 and the light-receiving element 403 are disposed at both sides of the disk 401, thereby obtaining a pulse-shaped ON/OFF signal corresponding to a rotation amount of the right lower roller 66. By detecting a move angle (hereinafter, "angular displacement") of the right lower roller 66 using this pulse-shaped ON/OFF signal, a drive amount of the transfer driving motor 302 is controlled.

A belt mark 304 for managing a reference position of the transfer conveyer belt is fitted in a non-image forming area on the surface of the transfer conveyer belt 60. A mark sensor 305 fitted near the belt mark 304 detects ON/OFF of the belt mark 304. An effective driving radius of the right lower roller 66 changes due to a variance in the thickness of the transfer conveyer belt 60 as described later. Therefore, although the actual speed of the transfer conveyer belt 60 is constant, the encoder 301 detects that the speed varies. To prevent such error detection, a detection angular displacement error due to the belt thickness variation measured in advance is added to a control target value. By feedback controlling using the added result as a control target value, the belt is conveyed at a constant speed. The belt mark 304 is fitted to match the actual belt position with the position of the detection angular displacement error.

The control target value is variably controlled according to thickness profile data measured in advance, thereby canceling the error detection due to a belt thickness and making the belt run at a constant speed. The belt mark 304 is fitted to match the actual belt position with the position of the thickness profile data.

According to the proportional control calculation, a difference between the target angular displacement and the detection angular displacement for each control period is multiplied by a control gain, thereby controlling the driving speed of the transfer driving motor 302, as described above. Therefore, when the detection angular displacement error due to the belt thickness is large, the driving motor is driven in a more amplified manner. As a result, a speed variation of the transfer conveyer belt 60 occurs due to the belt thickness, causing a color drift.

As described above, when the transfer driving motor 302 is driven at a constant speed, even when the transfer conveyer belt 60 is ideally conveyed without a speed variation, the driven effective radius of the belt increases when a thick part of the belt is wound around the driven axis. As a result, the rotation angular displacement of the driven axis per constant time decreases. This is detected as a decrease in the belt conveyance speed. When a thin part of the belt is wound around the driven axis, the rotation angular displacement of the driven axis increases, and this is detected as an increase in the belt conveyance speed.

Figure 25:
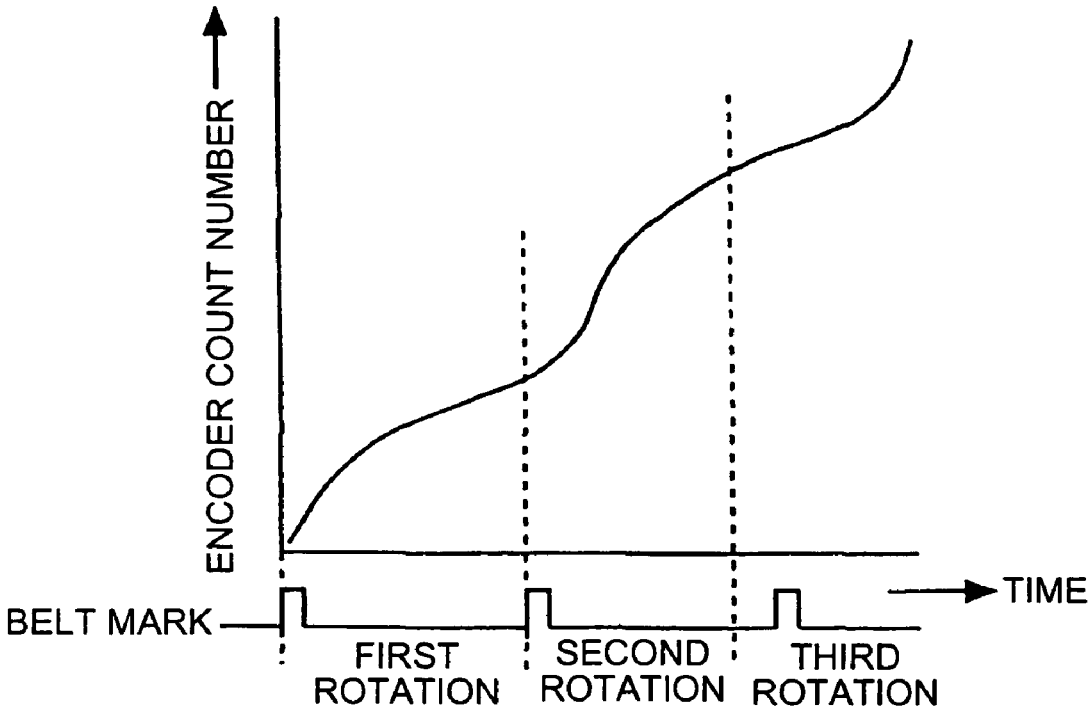
FIG. 25 is a graph for explaining a state in which a transfer driving motor is driven at a constant speed.

A behavior of the belt when the transfer driving motor 302 is driven at a constant speed is explained above. In other words, when a result of sampling a count value of the encoder 301 at a constant timing is as shown in FIG. 25, the right lower roller 66 is rotating at a constant speed. Therefore, in the present invention, as shown in FIG. 25, a target angular displacement for each control period is generated, and the encoder 301 is controlled according to the target angular displacement, thereby making the belt speed constant.

Instead of preparing a control parameter by measuring the actual thickness of the transfer conveyer belt 60 in the micrometer unit, it is prepared by using a detection angular displacement error of the encoder in a rad unit that occurs due to a belt thickness.

Since the control parameter is generated from a result of an output from the encoder when the transfer driving motor 302 is driven at a constant speed, an actual device can generate the control parameter. A measuring device that measures a thickness of the belt is not necessary, and the device can be configured at very low cost.

As described later, a belt thickness is a characteristic of a sinusoidal wave in most cases. Therefore, when a high-resolution measurement with an external tool is possible, the external tool calculates a phase and a maximum amplitude at the belt mark 304 based on the measurement result. The calculation result is input as a control parameter using the operation panel of the actual device, thereby achieving the control.

In the actual result of an output from the encoder 301, not only the detection angular displacement error due to a belt thickness, but also variations in the driving roller and other constituent elements and rotation eccentricity components are superimposed in the output. Therefore, only an influential component of the driven roller is extracted from the output result, and the extracted result is used as a control parameter of a detection angular displacement error.

Figure 5:
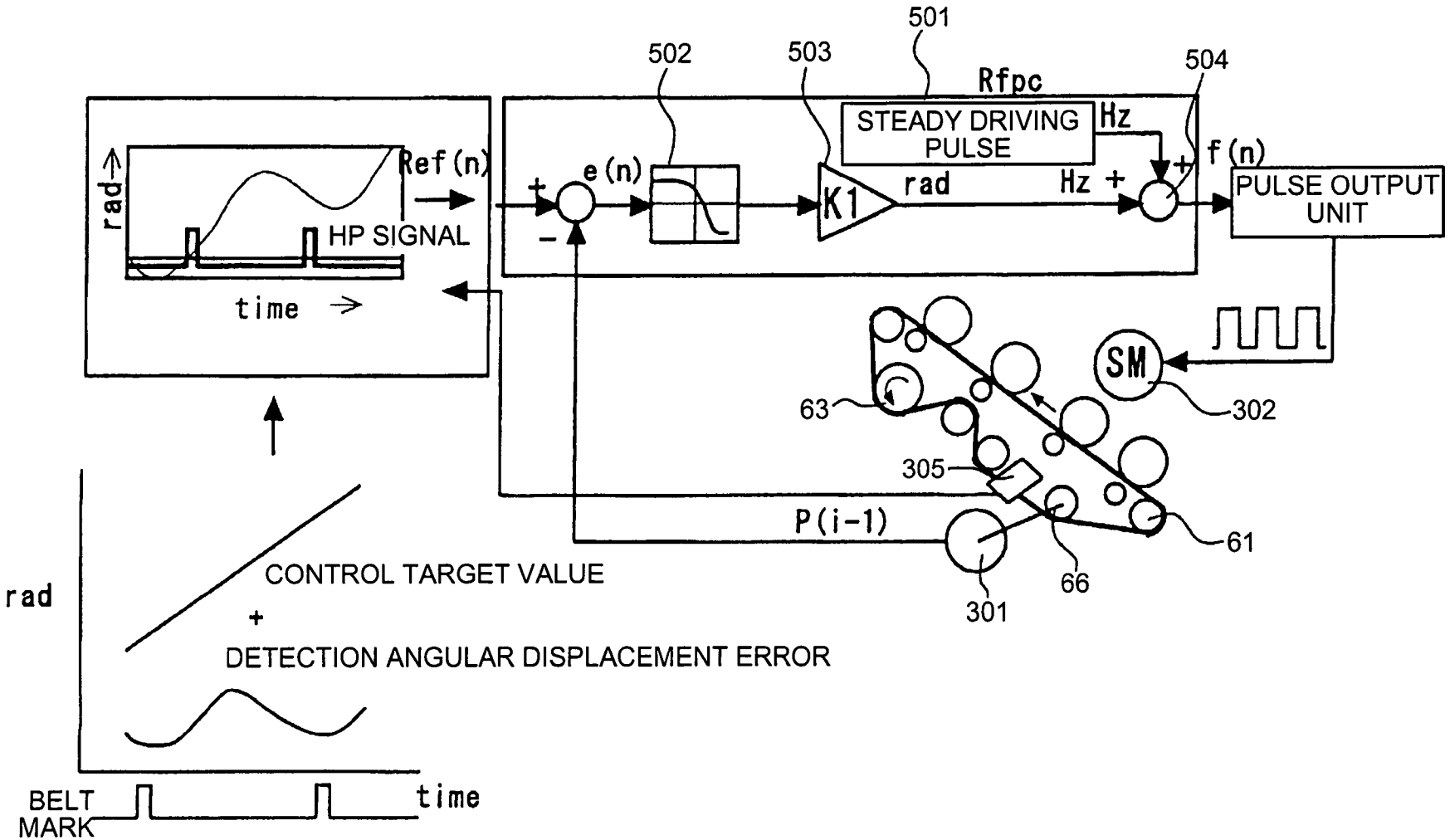
FIG. 5 is a diagram for explaining a configuration of a drive control device according to the embodiment.

FIG. 5 is a diagram for explaining a configuration of a drive control device according to the present embodiment. The application of the drive control device according to the present embodiment to a rotation unit driving apparatus according to the above embodiment is explained below.

A difference e(n) between a target angular displacement Ref(n) of the encoder 301 and a detection angular displacement P(n−1) of the encoder 301 is input to a controller unit 501. The controller unit 501 includes a lowpass filter 502 that removes high-frequency noise, and a proportional element (gain Kp) 503. The controller unit 501 obtains a correction amount of a standard driving pulse frequency that is used to drive the transfer driving motor 302, and applies this correction amount to a calculating unit 504. The calculating unit 504 adds the correction amount to a constant standard driving pulse frequency Refp_c, and determines a driving pulse frequency f(n).

A control target value added with the detection angular displacement error generated due to the variation in the thickness of the transfer conveyer belt 60 is generated for the target angular displacement Ref(n). By taking a difference e(n) between the control target value and a detection angular displacement P(n−1) detected by the encoder 301, a displacement amount of the difference is obtained. The detection angular displacement error generated due to the variation in the thickness of the transfer conveyer belt 60 is periodically and repetitively added according to the output timing of the mark sensor 305 detected by the rotation of the transfer conveyer belt 60.

Figure 6:
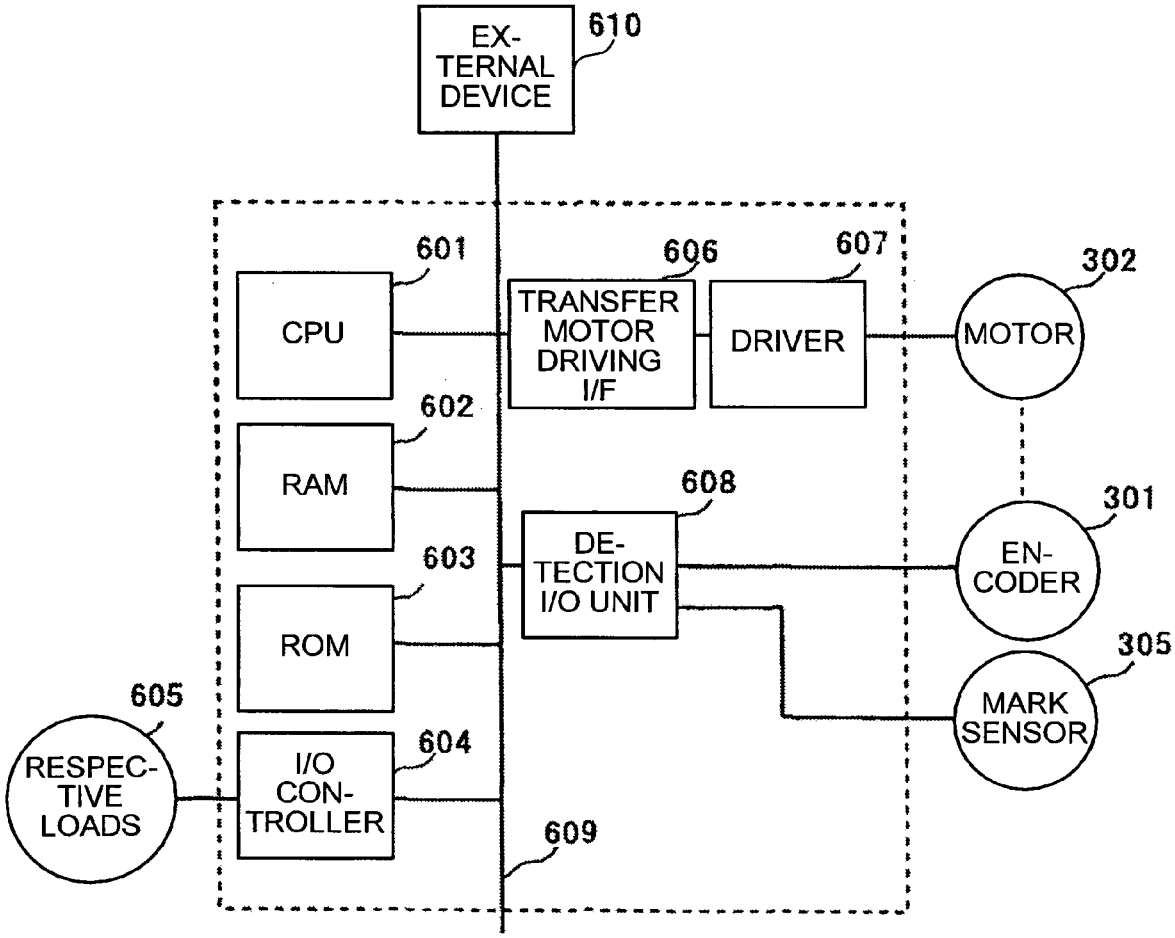
FIG. 6 is a diagram for explaining a hardware configuration of a control system of a transfer driving motor and a controlled item according to the embodiment.

FIG. 6 is a diagram for explaining a hardware configuration of a control system of the transfer driving motor 302 and a controlled item according to the present embodiment. The control system digitally controls the driving pulse of the transfer driving motor 302 based on the output signal of the encoder 301. The control system includes a central processing unit (CPU) 601, a random access memory (RAM) 602, a read only memory (ROM) 603, an input/output (I/O) controller 604, a transfer motor driving interface (I/F) 606, a driver 607, a detection I/O unit 608, and a bus 609.

The CPU 601 controls a reception of image data input from an external device 610, controls a transmission and a reception of a control command, and controls the entire image forming apparatus. The RAM 602 that is used for work, the ROM 603 that stores a program, and the I/O controller 604 are connected to one another via the bus. Based on instructions from the CPU 601, the control system executes various kinds of operation of a motor that executes a read/write processing of data and drives loads, a clutch, a solenoid, and a sensor.

The transfer motor driving I/F 606 outputs a command signal for instructing a driving frequency of a driving pulse signal to the transfer driving motor 302 via the driver 607, based on a drive command from the CPU 601. The transfer driving motor 302 is driven according to the above frequency. Therefore, the driving speed can be variably controlled.

An output signal from the encoder 301 is input to the detection I/O unit 608. The detection I/O unit 608 processes the output pulse of the encoder 301, and converts the processed result into a digital value. The detection I/O unit 608 has a counter that counts an output pulse of the encoder 301. The detection I/O unit 608 multiplies a value counted by the counter with a conversion constant of a predetermined pulse number versus angular displacement, thereby converting the count value into a digital value corresponding to an angular displacement of the right lower roller axis. A signal of the digital value corresponding to the angular displacement of the disk is sent to the CPU 601 via the bus 609.

The transfer motor driving I/F 606 generates a pulse-shaped control signal having a driving frequency based on the command signal of the driving frequency sent from the CPU 601.

The driver 607 includes power semiconductor elements (for example, transistors). The driver 607 operates based on a pulse-shaped control signal output from the transfer motor driving I/F 606, and applies the pulse-shaped driving voltage to the transfer driving motor 302. As a result, the transfer driving motor 302 is drive-controlled in a predetermined driving frequency output from the CPU 601. Accordingly, the angular displacement of the disk 401 is controlled to follow the target angular displacement, and the right lower roller 66 is rotated at a predetermined equal angular velocity. The encoder 301 and the detection I/O unit 608 detect the angular displacement of the disk 401. The CPU 601 takes in the detected angular displacement, and repeats the control.

The RAM 602 is used as a work area for executing a program stored in the ROM 603, and also stores detection angular displacement error data for full circle of the belt from the belt mark 304 corresponding to the variation in the thickness of the transfer conveyer belt 60 measured in advance.

Figure 7:
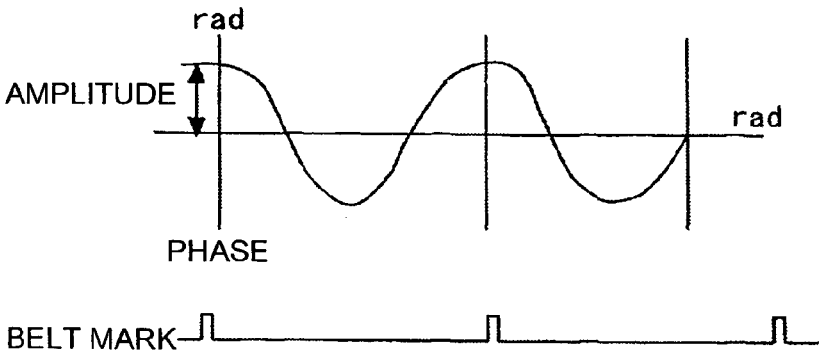
FIG. 7 is a diagram for explaining parameters of phase, amplitude, and period of a belt stored in a volatile memory.

Since the RAM 602 is a volatile memory, phase and amplitude parameters of the belt as shown in FIG. 7 are stored in a volatile memory such as an electronic erasable programmable read-only memory (EEPROM) (not shown). When the power source is turned on or when the transfer driving motor 302 is started, data for one period of the belt is developed in the RAM 602 using a Sin function or an approximate expression. An actual thickness of the belt largely depends on a manufacturing process. In most cases, the belt thickness is in the Sin shape, and it is not particularly necessary to keep the entire detection angular displacement error data of full circle of the belt. When the phase and the amplitude are calculated from the reference position at the measuring time, and when the detection angular displacement error data is calculated based on the data, the result can be used as sufficiently equivalent data.

Therefore, the detection angular displacement error data for each control period does not need to be stored in a nonvolatile memory. Since the detection angular displacement error data due to the belt thickness is generated based on only the phase and amplitude parameters, only the area for the volatile memory is sufficient to carry out the control. The detection angular displacement error data due to the belt thickness is generated when the power source is turned on or when the transfer motor is started, based on the following expression:

$\Delta\theta$ [rad]: A rotation angular velocity variation of the driven axis [$=b\times\sin(2\times\pi\times ft+\tau)$].

The above $\Delta\theta$ is calculated according to the control time from the belt mark 304, and is sequentially stored into the RAM 602 as a volatile memory. In actually driving the transfer driving motor 302, data is read by switching the reference address in the RAM 602 according to the timing when the mark sensor 305 detects the belt mark 304. By adding the read data to the control target angular displacement, feedback control is carried out without the influence of the belt thickness.

Figure 18:
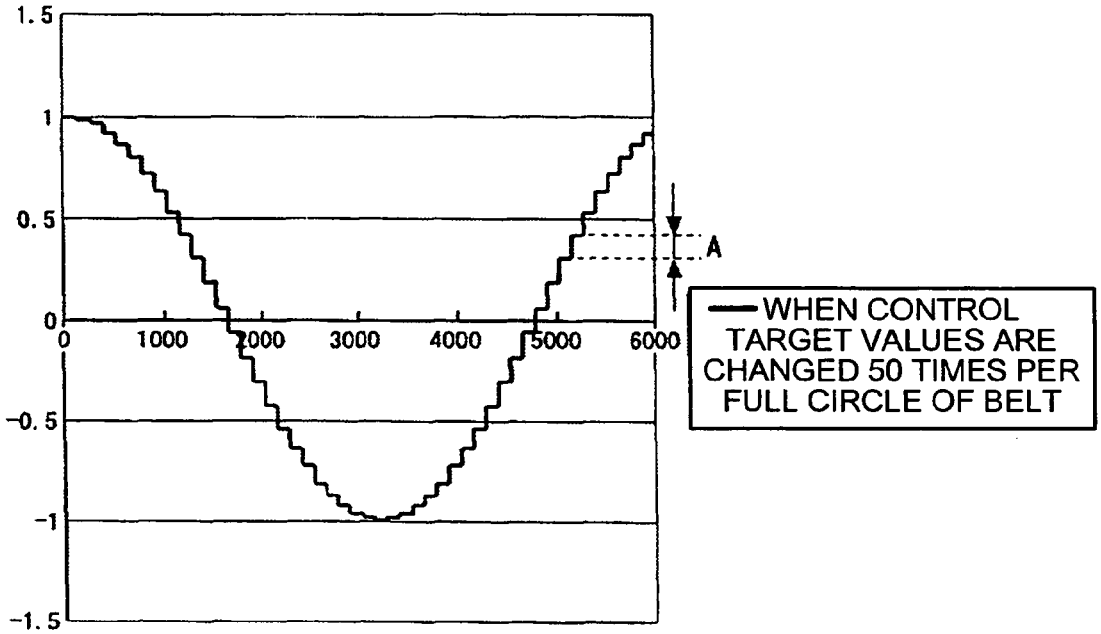
FIG. 18 is a graph of profile data when control target value is changed by about 50 times per full circle of a belt.

When only the peak value of a speed variation due to the belt thickness is decreased, the detection angular displacement error data due to the belt thickness for each control period is not necessary. Therefore, to reduce the memory area, profile data is obtained when control target value is changed by about 50 points per full circle of the belt as shown in FIG. 18. When the transfer conveyer belt reaches each point, the thickness profile data is updated, thereby sufficiently reducing the peak value.

However, when the number of times of changing the control target value per full circle of the belt is decreased and this number becomes smaller, a value immediately before being updated has an error with respect to an ideal value, as shown by A in FIG. 18. Consequently, at least this error is output as a variation in the speed of the belt.

Therefore, in the present embodiment, the number of times of changing the control target value per full circle of the belt is changed according to the quality of the image formed. When a high-definition image is printed, the number of times of changing the control target value is increased, thereby decreasing errors and minimizing a variation in the speed of the belt. On the other hand, when a low-definition image is printed, the number of times of changing the control target value is decreased, thereby reducing the control load. In this case, a permissible number is selected when the number of errors increases to some extent and when a speed variation occurs.

In the above operation, control is switched over depending on the image quality, such as high resolution and low resolution of printing like 1200/600 dots per inch, or a natural image and a text image.

Figure 19:
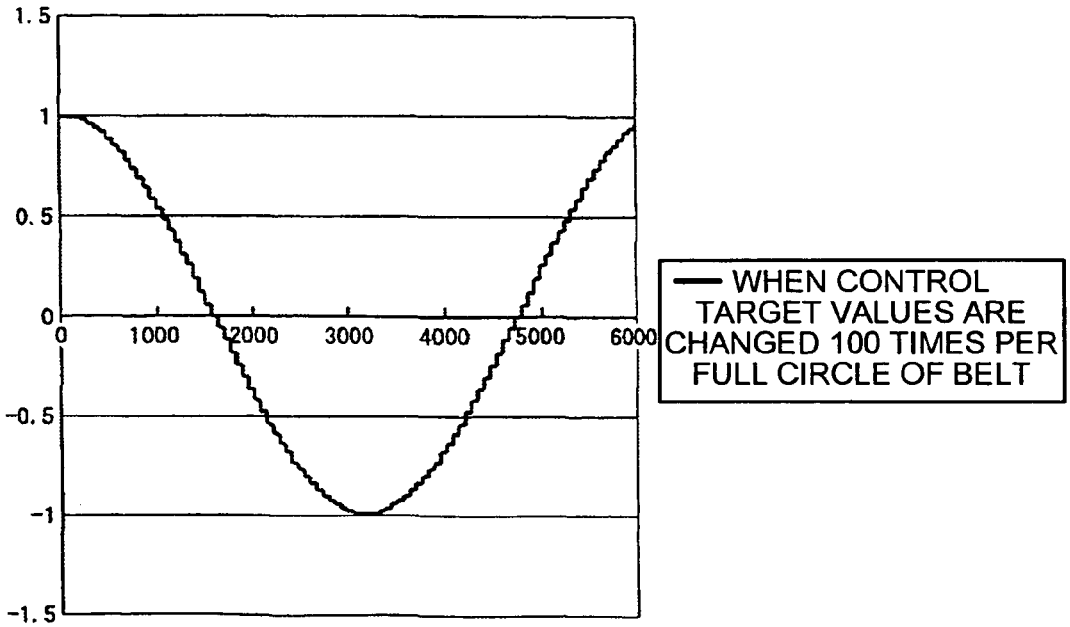
FIG. 19 is a graph of profile data when control target value is changed by 100 times per full circle of the belt.
Figure 20:
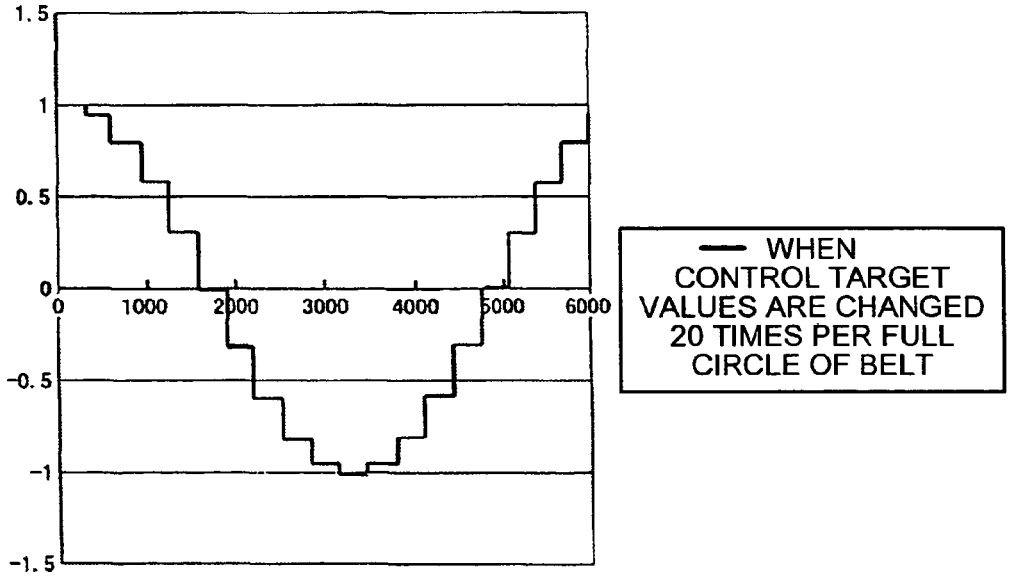
FIG. 20 is a graph of profile data when control target value is changed by 20 times per full circle of the belt.
Figure 21:
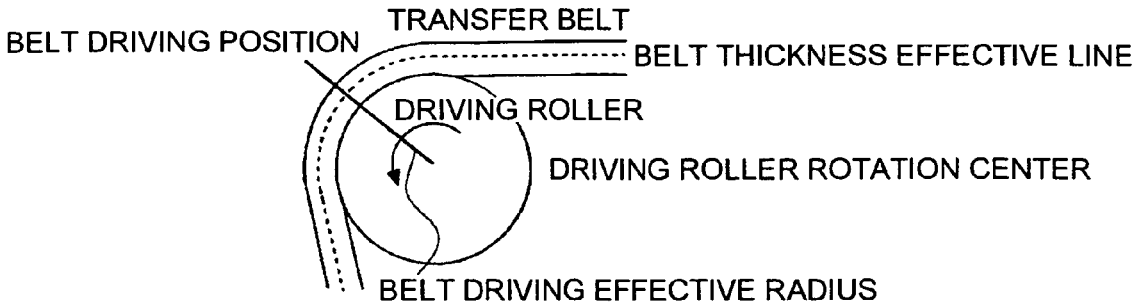
FIG. 21 is a diagram for explaining a relationship between a driving roller and a transfer belt.
Figure 22:
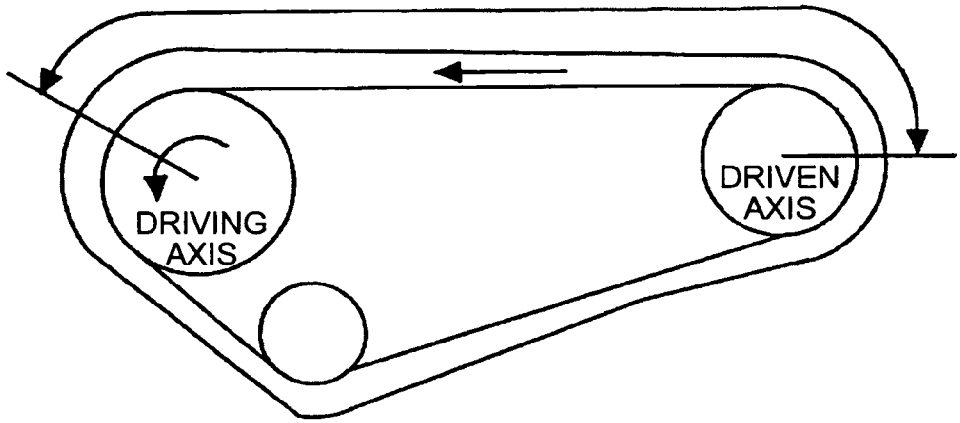
FIG. 22 is a diagram for explaining a concept of a variation in a belt thickness and a variation in a belt conveyance speed over full circle of a belt when a driving axis is rotated at a constant angular velocity.
Figure 23:
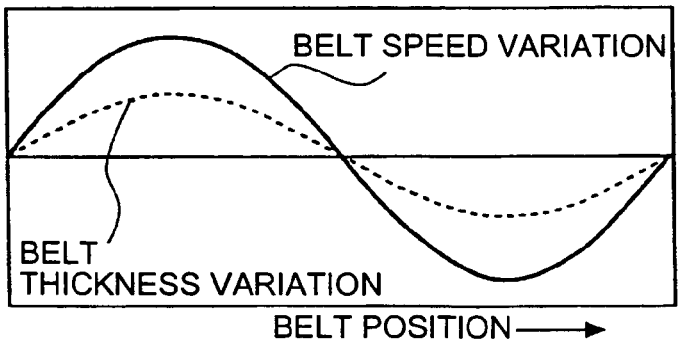
FIG. 23 is a graph of a variation in a belt thickness on a driven axis and a variation in a belt conveyance speed (1) detected on the driven axis when the belt is conveyed at a constant conveyance speed.
Figure 24:
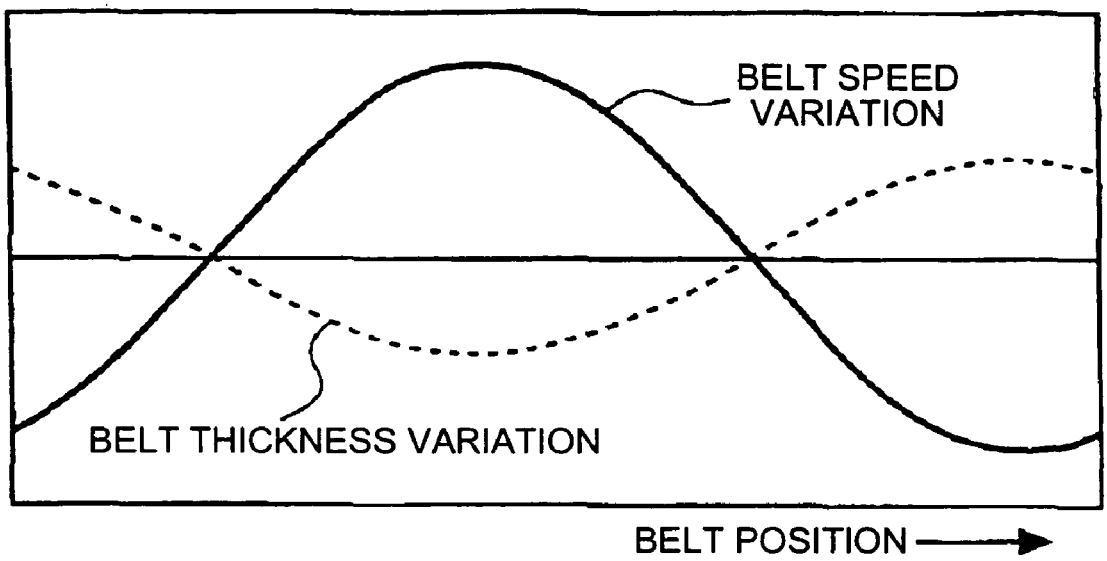
FIG. 24 is a graph of a variation in a belt thickness on the driven axis and a variation in a belt conveyance speed (2) detected on the driven axis when the belt is conveyed at a constant conveyance speed.

When the image quality is high as shown in FIG. 19, belt thickness profile data is changed by 100 points per full circle of the belt, and when the image quality is low as shown in FIG. 20, belt thickness profile data is changed by 20 points per full circle of the belt. In this way, the control is switched over depending on the image quality. This is effective to reduce a memory capacity and to shorten the time of developing profile data in the memory.

When there is no time for developing data before starting printing, plural memory areas for storing the several kinds of profile data are prepared. The data are collectively developed when the power source is turned on. A memory area to be used for forming an image is selected, thereby obtaining the equivalent effect.

FIG. 19 is a graph of profile data when control target value is changed by about 100 points per full circle of a belt. FIG. 20 is a graph of profile data when control target value is changed by about 20 points per full circle of a belt.

Figure 8:
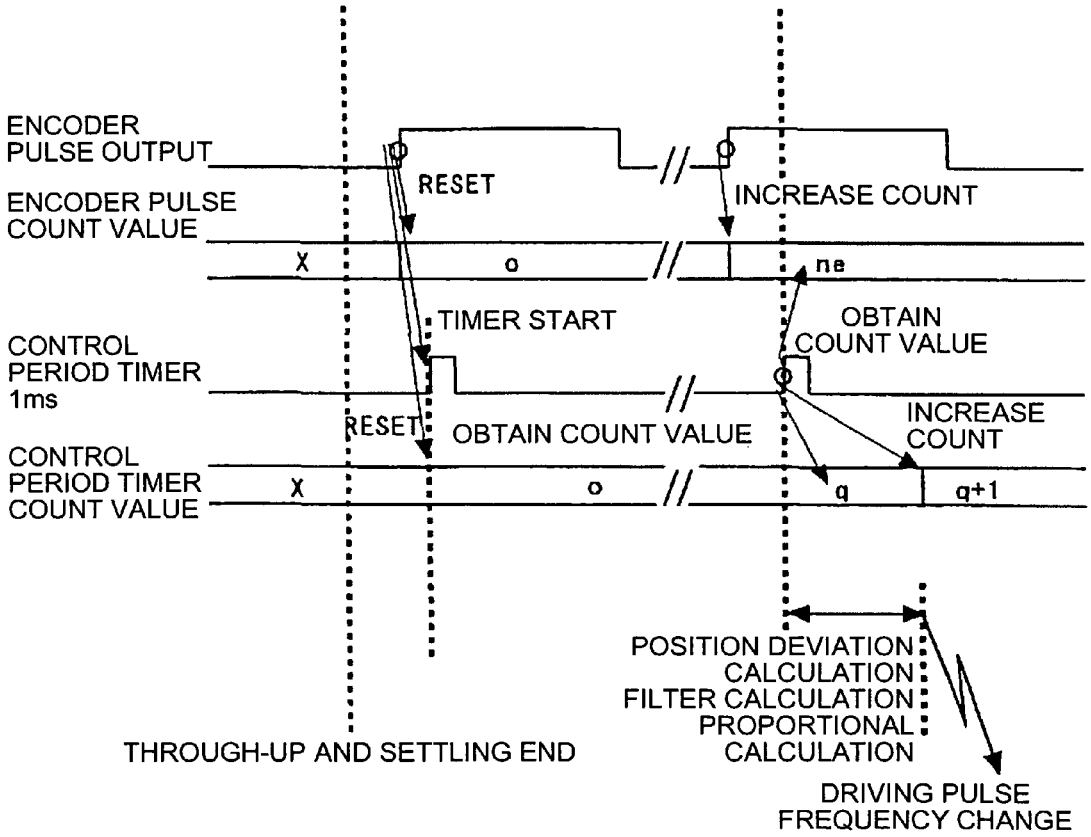
FIGS. 8 and 9 are timing charts of control according to the embodiment.
Figure 9:
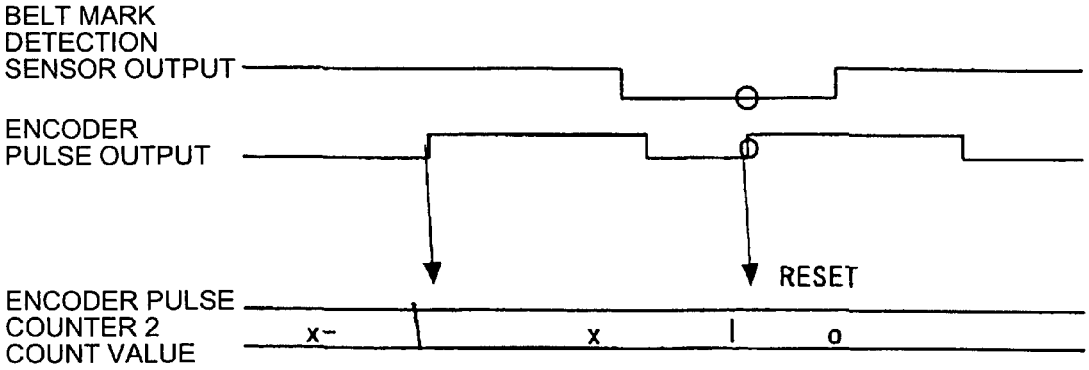

FIGS. 8 and 9 are timing charts for achieving the above control. A count value of an encoder pulse counter 1 is increased at a rising edge of an A phase output of an encoder pulse. A control period of the above control is 1 millisecond. Each time when a control period timer interrupts the CPU 601, a count value of a control period timer counter is increased. The timer is started when a rising edge of the encoder pulse is detected for the first time after a through-up and a settling of the driving motor end. A count value of the control period timer counter is reset at the same time.

Each time when a microcomputer is interrupted by the control period timer, a count value ne of the encoder pulse counter 1 is obtained, a count value q of the control period timer counter is obtained, and the count values are increased. The count value of an encoder pulse counter 2 is increased at the rising edge of the A phase output of the encoder pulse, like the count value of the encoder pulse counter 1. The count value is reset at the rising edge of the first encoder pulse after the mark sensor 305 is input. Therefore, the encoder pulse counter 2 substantially counts a moving distance from the belt mark 304. According to the value, a reference address in the RAM 602 in which control target profile data per full circle of the belt is stored is switched.

A position deviation is calculated, based on the above count values, as follows:

$$E(n)\ [\text{rad}]=\theta_0\times q+(\Delta\theta-\Delta\theta_0)-\theta_1\times ne,$$

where e(n) [rad]: A position deviation (calculated at the sampling this time);

$\theta_0$ [rad]: A move angle per control period 1 [millisecond] ($=2\pi\times V\times 10-3/1\pi$ [rad]);

$\Delta\theta$ [rad]: A rotation angular velocity variation of a driven axis [$=b\times\sin(2\times\pi\times ft\times\tau)$] (a table reference value);

$\Delta\theta_0$ [rad]: A first obtained $\Delta\theta$ value after driving motor is started;

$\theta_1$ [rad]: A move angle per one pulse of encoder ($=2\pi/p$ [rad]);

q: A count value of control period timer;

V: A belt linear velocity [mm/s];

l: A right lower roller diameter [millimeter];

b: An amplitude that changes due to belt thickness [rad];

$\tau$: A phase of belt mark of belt thickness variation [rad]; and f: A period of belt thickness variation [Hertz].

According to the present embodiment, the external diameter of the driven roller to which the encoder is fitted is $\phi$15.515 [millimeter], and the belt thickness is 0.1 [millimeter]. While the driven roller is rotated based on the friction of the belt, approximately a half of the belt thickness is a practical core line for rotating the driven roller. Based on the above assumption, the roller diameter becomes as follows:

$$1=15.515+0.1=15.615\ [\text{millimeter}].$$

Figure 26:
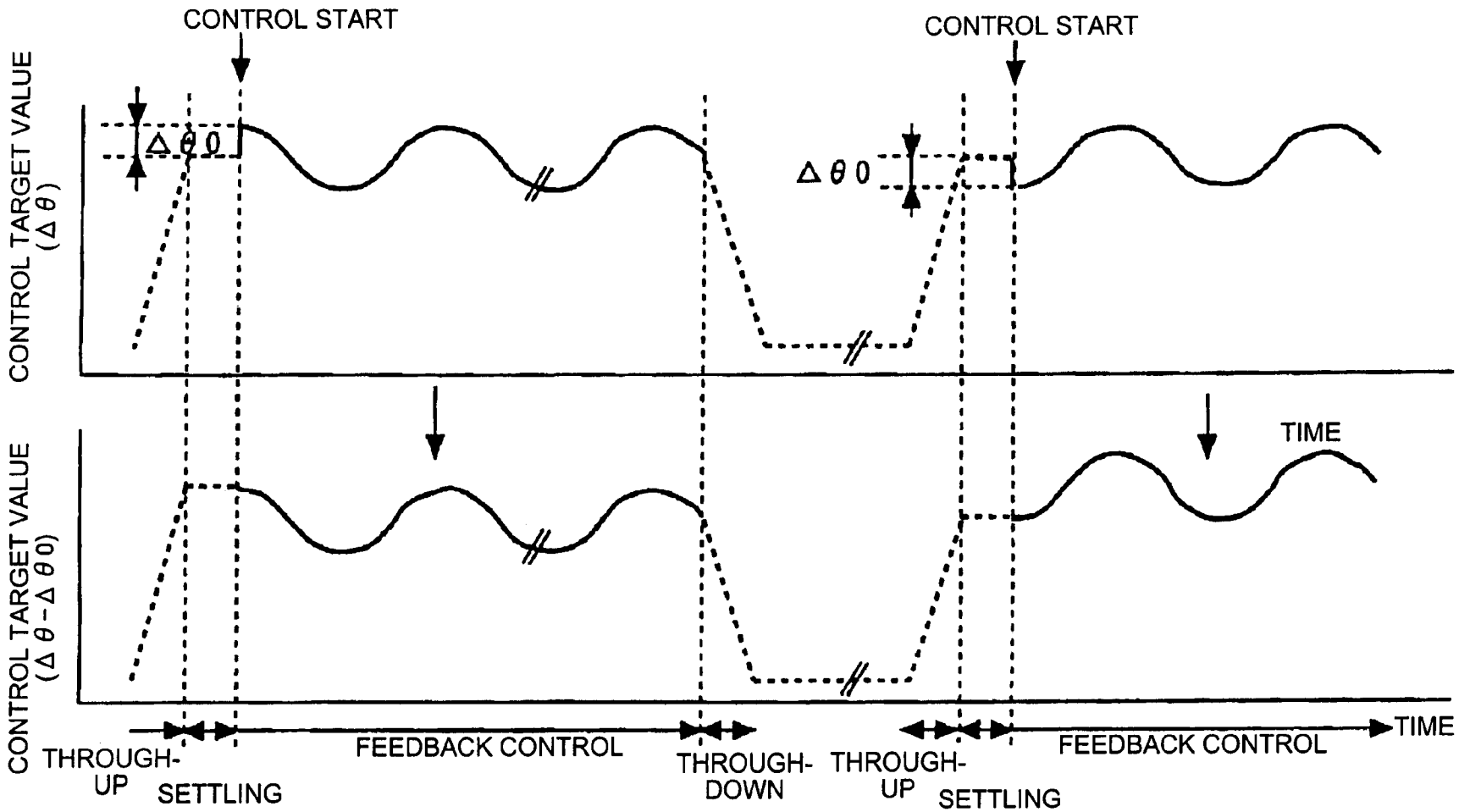
FIG. 26 is a graph for explaining a speed variation when a feedback control is started.

According to the present embodiment, resolution p of the encoder is 300 pulses per one rotation. Furthermore, in the present embodiment, the first obtained $\Delta\theta$ value after the transfer driving motor 302 is started is $\Delta\theta_0$. The first obtained $\Delta\theta_0$ after the transfer driving motor 302 is started is subtracted from $\Delta\theta$ in the calculation expression "($\Delta\theta-\Delta\theta_0$)", thereby mitigating a sudden speed variation when the feedback control is started as shown in FIG. 26. The same $\Delta\theta_0$ is used during the rotation of the transfer driving motor 302, and this $\Delta\theta_0$ is updated each time when the transfer driving motor 302 is started.

To avoid responding to a sudden positional change, filter calculation of the following specification is carried out to the calculated deviation Filter type: Butterworth IIR lowpass filter;
Sampling frequency: 1 kilohertz (=control period);
Passband ripple (Rp): 0.01 decibel;
Stopband end attenuation (Rs): 2 decibels;
Passband end frequency (Fp): 50 hertz; and
Stopband end frequency (Fs): 100 hertz.

Figures 10, 11:
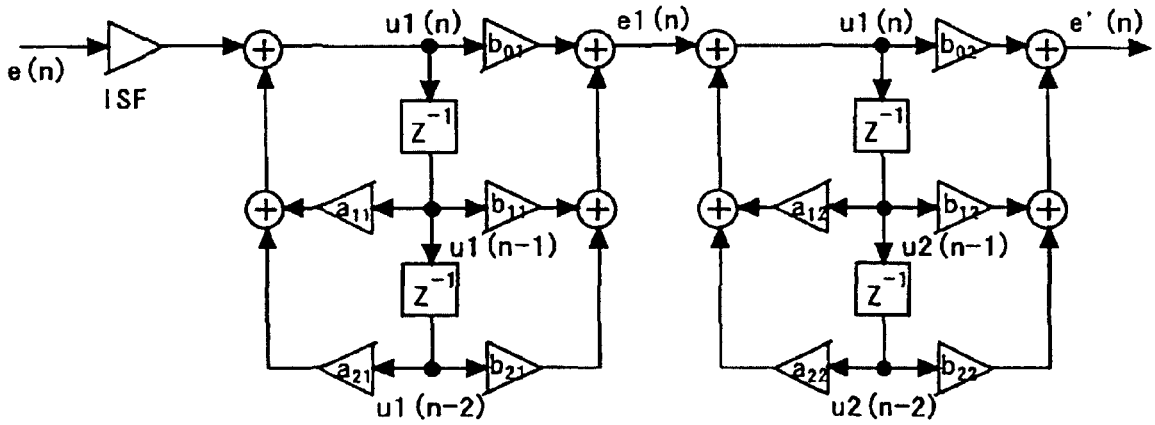
FIG. 10 is a graph of coefficients in a filter calculation.
FIG. 11 is a list of filter coefficients.

FIG. 10 is a block diagram of the filter calculation, and FIG. 11 is a list of filter coefficients. Filters are connected in cascade at two stages. Intermediate nodes at the stages are defined as u1(n), u1(n−1), and u1(n−2), and u2(n), u2(n−1), and u2(n−2). These indexes have the following meanings (n): A current sampling;
(n−1): A sampling one before; and
(n−2): A sampling two before.

The following programming calculation is carried out each time when the control timer is interrupted during the execution of the feedback:

$$u1(n)=a11\times u1(n-1)+a21\times u1(n-2)+e(n)\times ISF;$$

$$e1(n)=b01\times u1(n)+b11\times u1(n-1)+b21\times u1(n-2)$$

$$u1(n+2)=u1(n+1);$$

$$u1(n+1)=u1(n);$$

$$u2(n)=a12\times u2(n-1)+a22\times u2(n-2)+e1(n);$$

$$e'(n)=b02\times u2(n)+b12\times u2(n-1)+b22\times u2(n-2);$$

$$u2(n-2)=u2(n-1);\text{ and}$$

$$u2(n-1)=u2(n).$$

Figure 12:
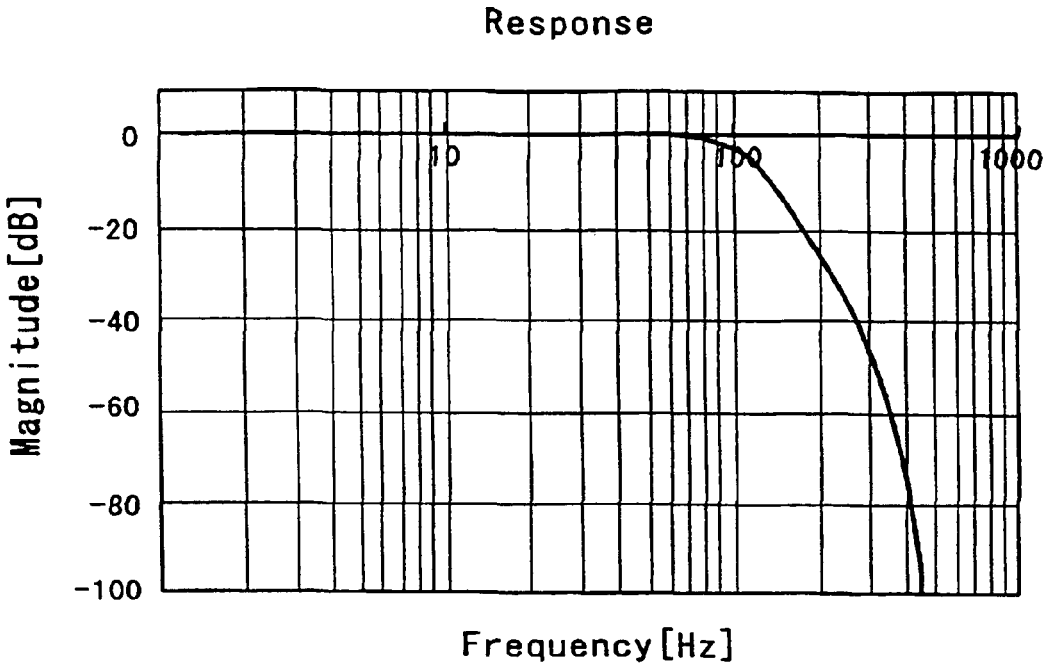
FIG. 12 is an amplitude characteristic diagram of a filter.
Figure 13:
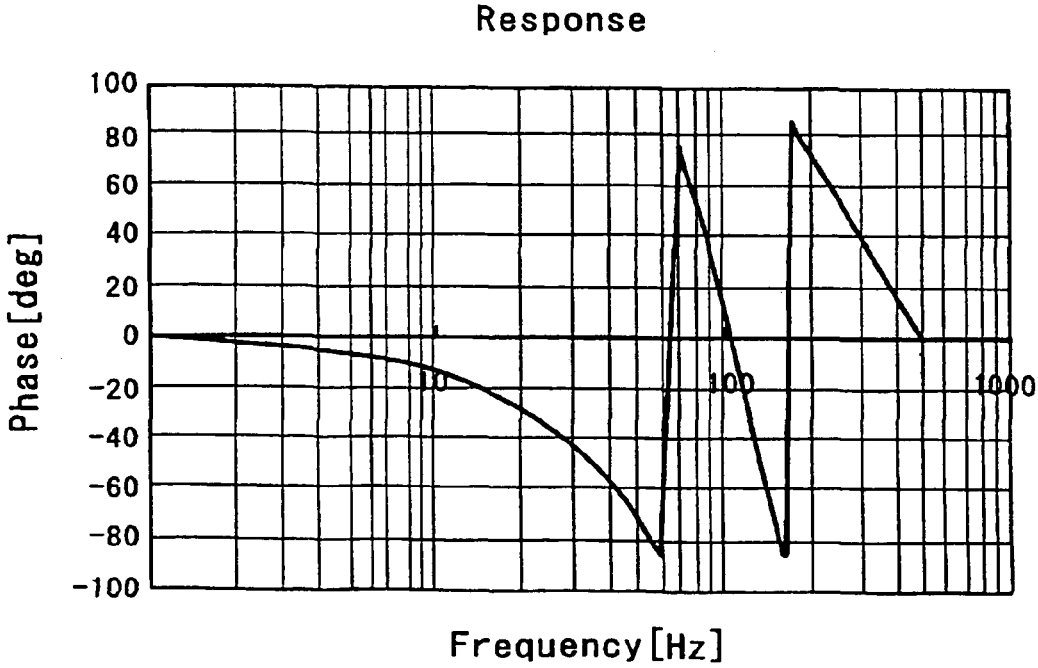
FIG. 13 is a phase characteristic diagram of the filter.

FIG. 12 is an amplitude characteristic diagram of the filter, and FIG. 13 is a phase characteristic diagram. A control amount of a controlled item is obtained. In the control block diagram, when a PID (P: proportional, I: integral, and D: differential) control is considered for a position controller, the following expression is obtained:

$$F(S)=G(S)\times E'(S)=Kp\times E'(S)+Ki\times E'(S)/S+Kd\times S\times E'(S),$$

where

Kp denotes a proportional gain;
Ki denotes an integration gain; and
Kd denotes a differential gain, and $$G(S)=F(S)/E'(S)=Kp+Ki/S+Kd\times S. \quad (1)$$

The expression (1) is bilinearly converted ($S=(2/T)\times(1-Z^{-1})/(1+Z^{-1})$) to obtain the following expression:

$$G(Z)=(b0+b1\times Z^{-1}+b2\times Z^{-2})/(1-a1\times Z^{-1}-a2\times Z^{-2}), \quad (2)$$

where a1=0;
a2=1;
b0=Kp+T×Ki/2+2×Kd/T;
b1=T×Ki−4×Kd/T; and
b2=−Kp+T×Ki/2+2×Kd/T.

Figure 14:
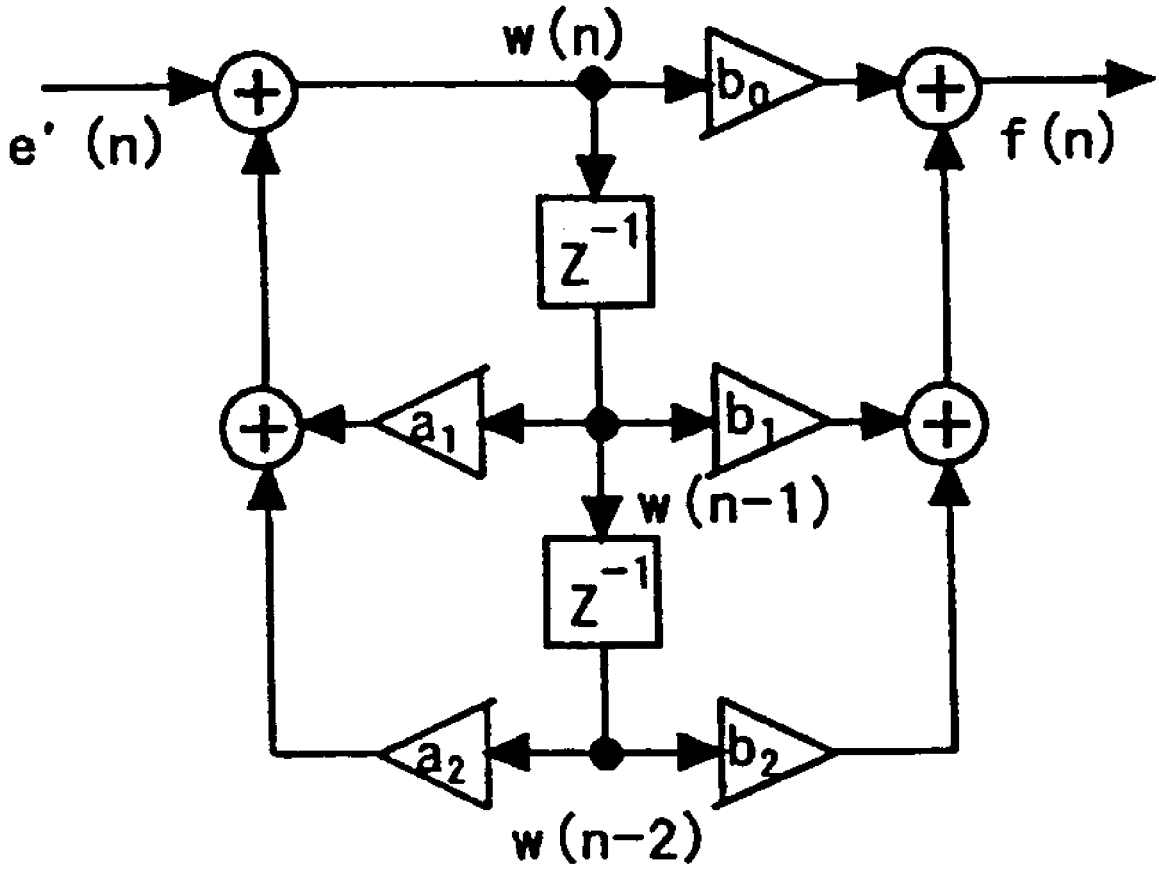
FIG. 14 is a diagram for explaining a proportional, integral, and differential (PID) control.

The expression (2) is expressed in a block diagram as shown in FIG. 14, where e' (n) and f(n) indicate that E' (S) and F(S) are handled as discrete data respectively. In FIG. 14, when intermediate nodes are defined as w(n), w(n−1), and w(n−2), the following differential equation is obtained (general expression of the PID control). These indexes have the following meanings (n): A current sampling;
(n−1): A sampling one before;
(n−2): A sampling two before;

$$w(n)=a1\times w(n-1)+a2\times w(n-2)+e'(n);\text{ and} \quad (3)$$

$$f(n)=b0\times w(n)+b1\times w(n-1)+b2\times w(n-2). \quad (4).$$

When a proportional control is considered for a position controller, an integral gain and a differential gain are zero. Therefore, coefficients shown in FIG. 14 become as follows, and the expressions (3) and (4) are simplified as follows:

a1=0;
a2=1;
b0=Kp;
b1=0;
b2=−Kp;

$$w(n)=w(n-2)+e'(n);\text{ and}$$

$$f(n)=Kp\times w(n)-Kp\times w(n-2)(\therefore f(n)=Kp\times e'(n)) \quad (5)$$

Discrete data f0(n) corresponding to F0(S) is 6105 Hertz, in other words, constant in the present embodiment. Therefore, a pulse frequency to be set to the transfer driving motor 302 is finally calculated based on the following expression:

$$f'(n)=f(n)+f0(n)=Kp\times e'(n)+6105\text{ [Hertz]} \quad (6)$$

Figure 15:
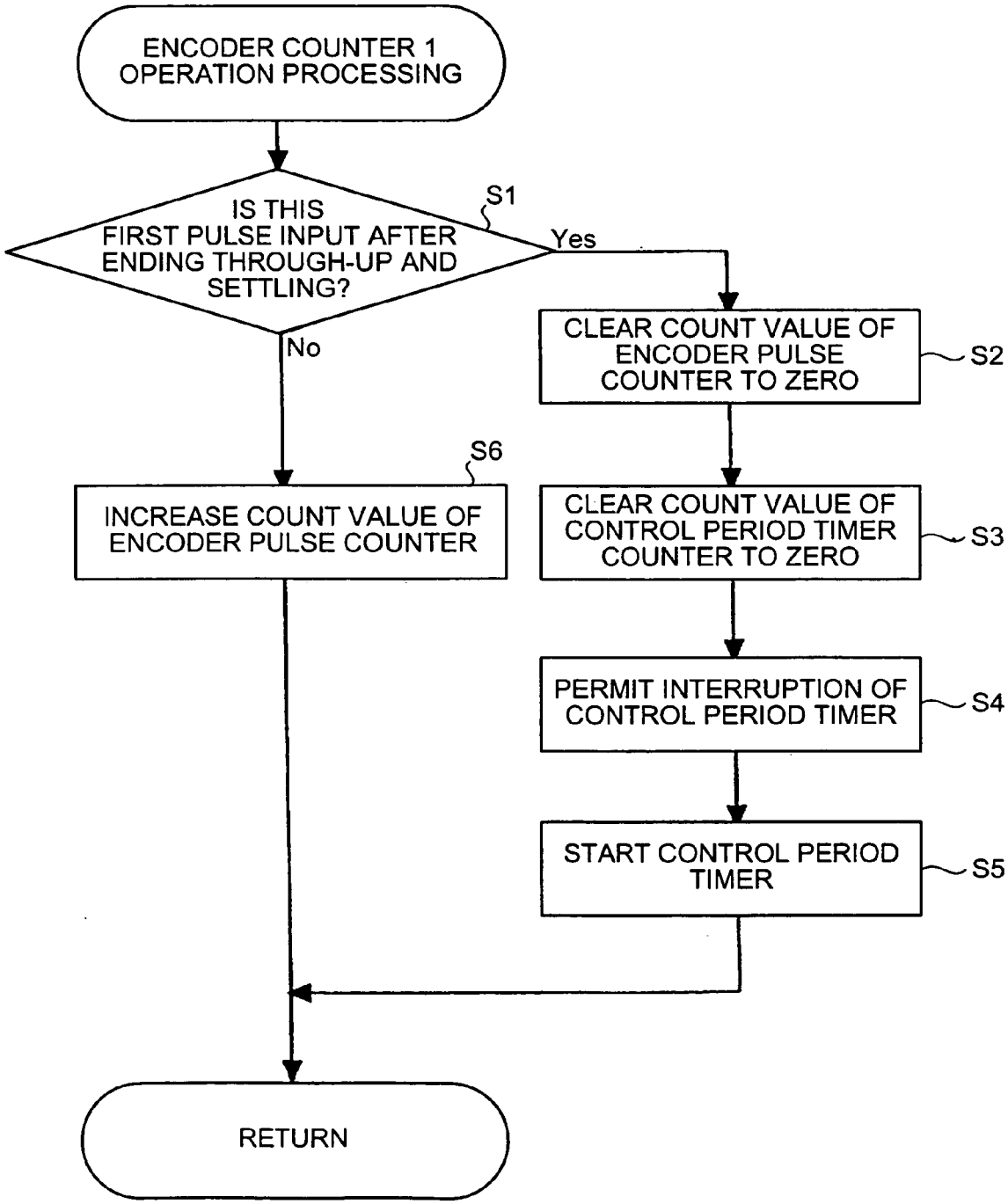
FIG. 15 is a flowchart of an interruption processing based on an encoder pulse.

FIG. 15 is a flowchart of the operation of the encoder pulse counter 1. It is determined whether a pulse input is the first input after the through-up and settling (step S1). When the determination result at step S1 is YES, the count value of the encoder pulse counter 1 is cleared to zero (step S2), the count value of the control period counter is cleared to zero (step S3), an interruption by the control period timer is permitted (step S4), the control period timer is started (step S5), and the process returns. When the determination result at step S1 is NO, the count value of the encoder pulse counter is increased (step S6), and the process returns.

Figure 16:
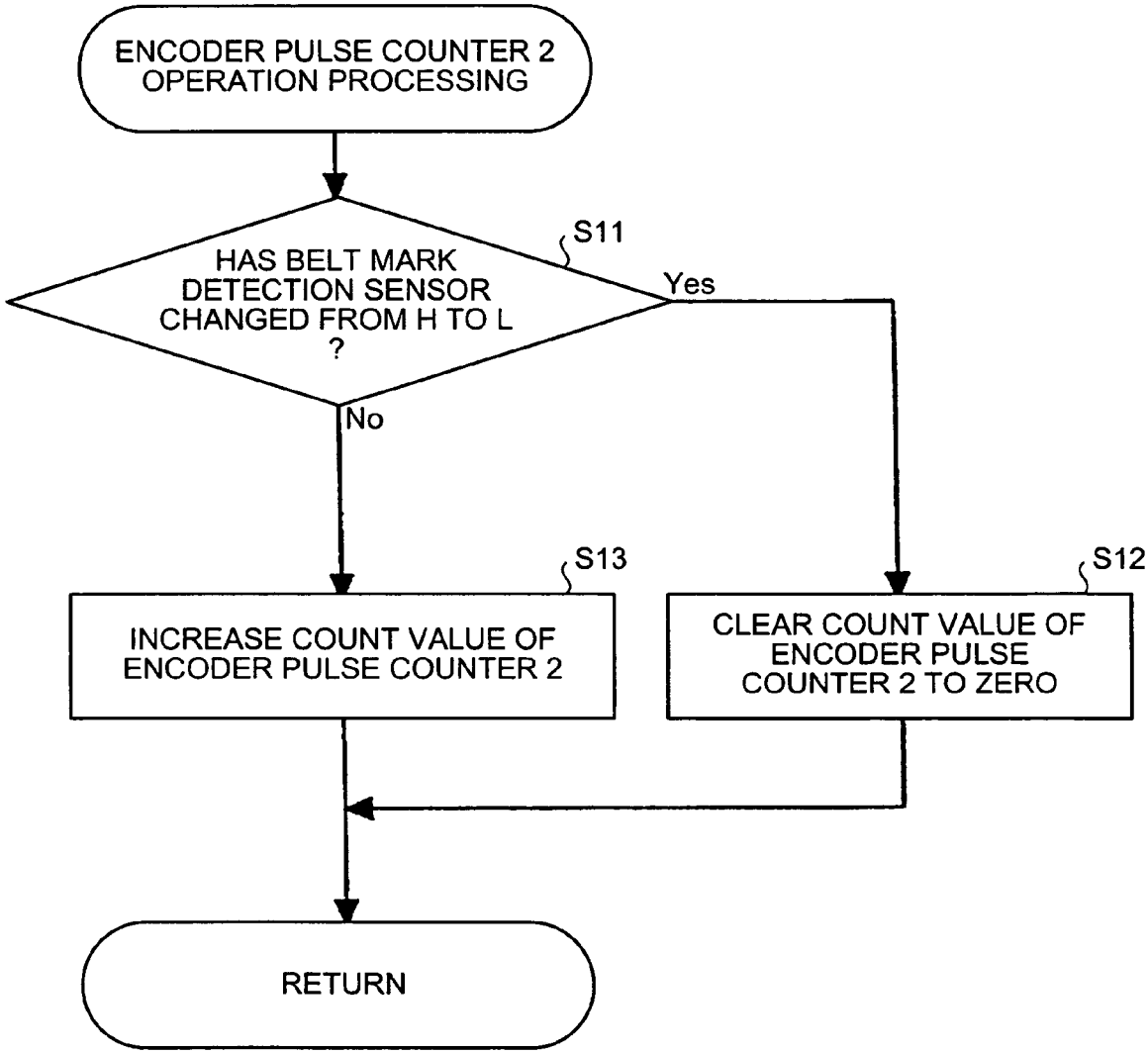
FIG. 16 is a flowchart of a processing performed by an encoder pulse counter.

FIG. 16 is a flowchart of the operation of the encoder pulse counter 2. When the encoder pulse is input, a state of the mark sensor 305 is determined (step S11). When the determination result at step S11 is YES, the count value of the encoder pulse counter 2 is cleared to zero (step S12). When the determination result at step S11 is NO, the count value of the encoder pulse counter 2 is increased (step S13), and the process returns.

Figure 17:
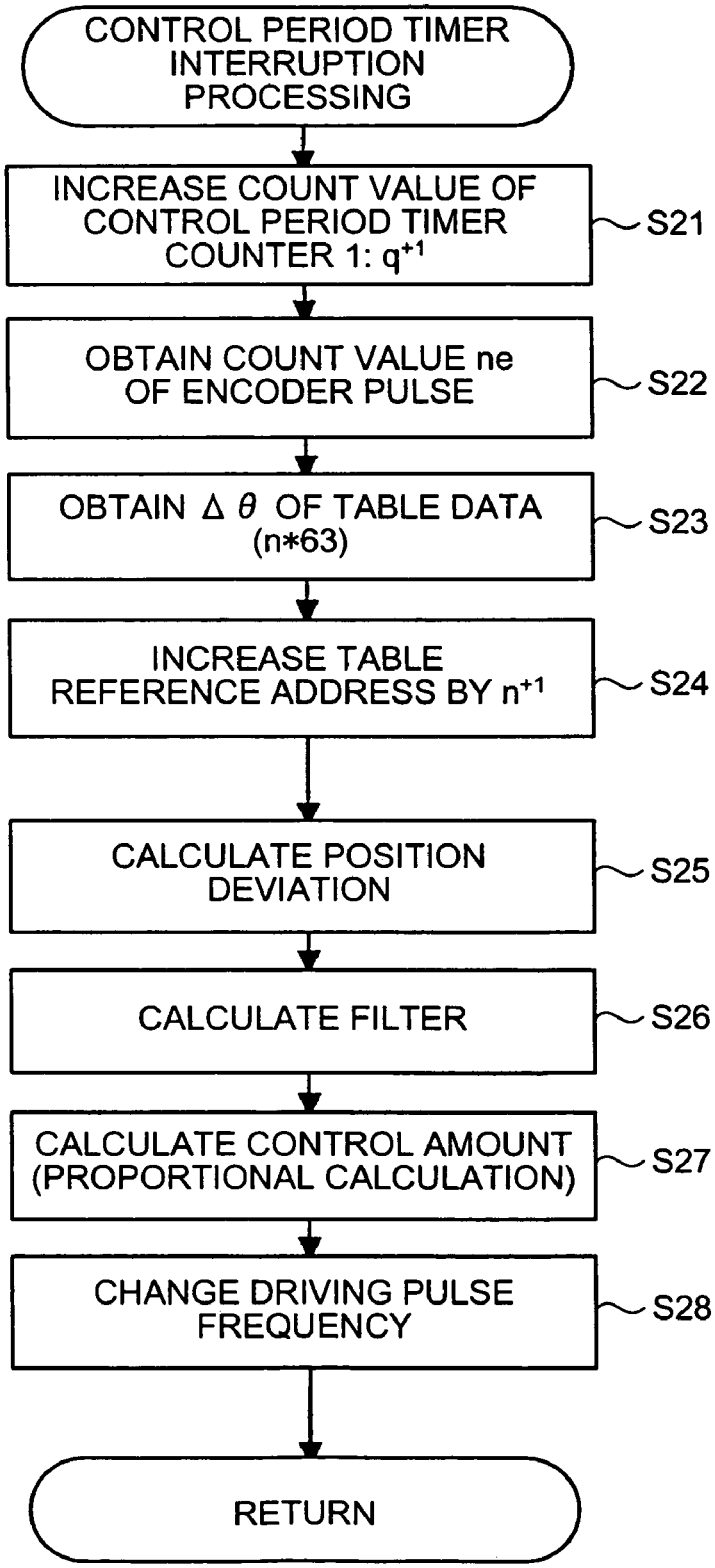
FIG. 17 is a flowchart of an interruption processing performed by a control period timer.

FIG. 17 is a flowchart of an interruption processing performed by the control period timer. The count value of the control period timer counter is increased (step S21), and the encoder pulse count value ne is obtained (step S22). The Δθ value is obtained by referring to table data (step S23), and the table reference address is increased (step S24). A position deviation is calculated using these values (step S25), and the obtained position deviation is filtered (step S26). The control amount is calculated (proportional calculation) based on the filter calculation result (step S27). The frequency of the driving pulse of the stepping motor is actually changed (step S28), and the process returns.

Based on the above control, the control of stabilizing the speed variation that is generated due to the belt thickness can be properly carried out at low cost according to the image quality.

According to the present invention, the drive control device of the present invention is applied to the transfer unit 6 in the tandem system printer in which the photoconductive drums 11Y, 11M, 11C, and 11K are disposed on the transfer conveyer belt 60. The configurations of the printer and the belt driving device to which the drive control device according to the present invention can be applied are not limited thereto. The drive control device according to the present invention can be applied to any belt driving device in a printer, in which the belt driving device drives an endless belt using at least one of plural rollers with which the endless belt is stretched.

According to the present invention, printing paper is conveyed with the transfer conveyer belt 60, and toners of four colors are directly transferred onto the printing paper from the photoconductive drum 11. It is also possible to apply the present invention to the intermediate transfer for transferring toners of four colors onto the transfer conveyer belt 60 and transferring the superimposed four colors onto the printing paper. While a laser beam is used as an exposure light source in the present embodiment, the light source is not limited to this, and a light-emitting diode (LED) array and the like can be also used. While the belt speed and the position are detected with the rotary encoder fitted to the driven roller axis, the detection method is not limited to this. A scale or a toner mark formed on the front surface or the back surface of the belt can be also detected. Although the controller carries out the PI control, the controller can also carry out a P (proportional) control, the PID control, or an H control.

According to the present invention, the drive control device for an endless belt refers to profile data stored in the volatile memory according to a distance from a mark when the endless belt is driven, and adds the profile data to the control target value, thereby stabilizing the speed variation due to a belt thickness. Therefore, the drive control device for an endless belt that can properly function at low cost can be provided.

According to the present invention, the drive control device for an endless belt adds the profile data to the control target value, thereby carrying out the drive control. Therefore, the drive control device for an endless belt that can stabilize the speed variation due to the belt thickness can be provided.

According to the present invention, the drive control device for an endless belt that can reduce a memory capacity of the volatile memory can be provided.

According to the present invention, the drive control device for an endless belt stores data into the volatile memory by thinning the data. Therefore, the drive control device for an endless belt that can reduce the memory capacity of the volatile memory can be provided.

According to the present invention, the drive control device for an endless belt stores data into the volatile memory by thinning the data. Therefore, the drive control device for an endless belt that can reduce the memory capacity of the volatile memory can be provided.

According to the present invention, the drive control device for an endless belt switches the control depending on the image quality of print resolution, a natural image, and a text image. Therefore, the drive control device for an endless belt that can reduce the memory capacity and shorten the time of developing profile data in the memory can be provided.

According to the present invention, the image forming apparatus refers to profile data stored in the volatile memory according to a distance from a mark when the endless belt is driven, and adds the profile data to the control target value, thereby stabilizing the speed variation due to a belt thickness. Therefore, the image forming apparatus that can properly function at low cost can be provided.

According to the present invention, the image forming apparatus adds the profile data to the control target value, thereby carrying out the drive control. Therefore, the image forming apparatus that can stabilize the speed variation due to the belt thickness can be provided.

According to the present invention, the image forming apparatus that can reduce a memory capacity of the volatile memory can be provided.

According to the present invention, the image forming apparatus stores data into the volatile memory by thinning the data. Therefore, the image forming apparatus that can reduce the memory capacity of the volatile memory can be provided.

According to the present invention, the image forming apparatus stores data into the volatile memory by thinning the data. Therefore, the image forming apparatus that can reduce the memory capacity of the volatile memory can be provided.

According to the present invention, the image forming apparatus switches the control depending on the image quality of print resolution, a natural image, and a text image. Therefore, the image forming apparatus that can reduce the memory capacity and shorten the time of developing profile data in the memory can be provided.

According to the present invention, the drive control device for an endless belt adds the profile data to the control target value, thereby carrying out the drive control. Therefore, the drive control device for an endless belt that can stabilize the speed variation due to the belt thickness can be provided.

According to the present invention, the drive control device for an endless belt adds the profile data to the control target value, thereby carrying out the drive control. Therefore, the drive control device for an endless belt that can stabilize the speed variation due to the belt thickness can be provided.

According to the present invention, the drive control device for an endless belt that can reduce a memory capacity of the volatile memory can be provided.

According to the present invention, the drive control device for an endless belt stores data into the volatile memory by thinning the data. Therefore, the drive control device for an endless belt that can reduce the memory capacity of the volatile memory can be provided.

According to the present invention, the drive control device for an endless belt that can prevent a transient variation in the control target value at the control starting time can be provided.

According to the present invention, the image forming apparatus adds the profile data to the control target value, thereby carrying out the drive control. Therefore, the image forming apparatus that can stabilize the speed variation due to the belt thickness can be provided.

According to the present invention, the image forming apparatus adds the profile data to the control target value, thereby carrying out the drive control. Therefore, the image forming apparatus that can stabilize the speed variation due to the belt thickness can be provided.

According to the present invention, the image forming apparatus that can reduce the memory capacity of the volatile memory can be provided.

According to the present invention, the image forming apparatus stores data into the volatile memory by thinning the data. Therefore, the image forming apparatus that can reduce the memory capacity of the volatile memory can be provided.

According to the present invention, the image forming apparatus that can prevent a transient variation in the control target value at the control starting time can be provided.

According to the present invention, operability of the image forming apparatus can be improved by the input operation using the operation panel.

Furthermore, the present invention can be applied to the image forming apparatus configured by four continuous tandems.

Moreover, the present invention can be applied to the image forming apparatus that uses an intermediate transfer conveyer belt and a direct transfer conveyer belt.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. An apparatus for controlling a driving motor that drives a driving roller based on an output signal from an encoder attached to a driven roller, the apparatus comprising:

an endless belt that is driven by the driving roller, the endless belt bearing a mark indicating a reference position and having a thickness of which variation is represented by a function of a phase, a maximum amplitude, and a period;

a reference-position detector that detects the reference position by detecting the mark;

a nonvolatile memory that stores the phase at the reference position, the maximum amplitude, and the period;

a correction-value calculating unit that calculates a correction value for a position on the endless belt based on a thickness of the endless belt at the position, the thickness being determined by the phase, the maximum amplitude, and the period;

a volatile memory that stores the correction value calculated; and a target-value calculating unit that reads out the correction value for the current position from the volatile memory based on a distance from the reference position to the current position, and adjusts a target value for controlling the driving motor based on the correction value to compensate for a variation in the output signal from the encoder due to the variation in the thickness of the endless belt.

2. The apparatus according to claim 1, wherein the correction-value calculating unit calculates the correction value at a time of turning on the apparatus or a driving of the endless belt.

3. The apparatus according to claim 1, wherein the function is a sine function.

4. The apparatus according to claim 1, wherein the volatile memory stores a plurality of correction values corresponding to a plurality of positions determined by a predetermined interval.

5. The apparatus according to claim 4, wherein the volatile memory is divided into a plurality of areas, and each of the areas stores the correction values corresponding to the positions determined by different intervals.

6. The apparatus according to claim 5, wherein the target-value calculating unit selects an area of the volatile memory from among the areas based on an image quality, and reads out the correction values from the area.

7. An apparatus for controlling a driving motor that drives a driving roller based on an output signal from an encoder attached to a driven roller so that an angular velocity of the encoder is kept at a target value, the apparatus comprising:

an endless belt that is driven by the driving roller, the endless belt bearing a mark indicating a reference position and having a thickness of which variation is represented by a function of a phase and a maximum amplitude;

a reference-position detector that detects the reference position by detecting the mark;

an angular-velocity-variation detecting unit that detects a variation in the angular velocity of the encoder due to the variation in the thickness of the endless belt;

a parameter calculating unit that determines the phase at the reference position and the maximum amplitude based on the variation in the angular velocity of the encoder;

a nonvolatile memory that stores the phase at the reference position and the maximum amplitude;

a correction-value calculating unit that calculates a correction value for a position on the endless belt based on a thickness of the endless belt at the position, the thickness being determined by the phase at the reference position and the maximum amplitude;

a volatile memory that stores the correction value calculated; and a target-value calculating unit that reads out the correction value for the current position from the volatile memory based on a distance from the reference position to the current position, and adjusts the target value based on the correction value to compensate for a variation in the output signal from the encoder due to the variation in the thickness of the endless belt.

8. The apparatus according to claim 7, wherein the correction-value calculating unit calculates the correction value at a time of turning on the apparatus or a driving of the endless belt.

9. The apparatus according to claim 7, wherein the function is a sine function.

10. The apparatus according to claim 7, wherein the volatile memory stores a plurality of correction values corresponding to a plurality of positions determined by a predetermined interval.

11. The apparatus according to claim 7, further comprising a correction-value adjusting unit that adjusts the correction value, based on which the target value is adjusted at a start of a control of the driving motor, to zero.

12. An image forming apparatus with a driving motor that drives a driving roller based on an output signal from an encoder attached to a driven roller, the image forming apparatus comprising:

an endless belt that is driven by the driving roller, the endless belt bearing a mark indicating a reference position and having a thickness of which variation is represented by a function of a phase, a maximum amplitude, and a period;

a reference-position detector that detects the reference position by detecting the mark;

a nonvolatile memory that stores the phase at the reference position, the maximum amplitude, and the period;

a correction-value calculating unit that calculates a correction value for a position on the endless belt based on a thickness of the endless belt at the position, the thickness being determined by the phase, the maximum amplitude, and the period;

a volatile memory that stores the correction value calculated; and a target-value calculating unit that reads out the correction value for the current position from the volatile memory based on a distance from the reference position to the current position, and adjusts a target value for controlling the driving motor based on the correction value to compensate for a variation in the output signal from the encoder due to the variation in the thickness of the endless belt.

13. The image forming apparatus according to claim 12, wherein the correction-value calculating unit calculates the correction value at a time of turning on the image forming apparatus or a driving of the endless belt.

14. The image forming apparatus according to claim 12, wherein the function is a sine function.

15. The image forming apparatus according to claim 12, wherein the volatile memory stores a plurality of correction values corresponding to a plurality of positions determined by a predetermined interval.

16. The image forming apparatus according to claim 15, wherein the volatile memory is divided into a plurality of areas, and each of the areas stores the correction values corresponding to the positions determined by different intervals.

17. The image forming apparatus according to claim 16, wherein the target-value calculating unit selects an area of the volatile memory from among the areas based on an image quality, and reads out the correction values from the area.

18. The image forming apparatus according to claim 12, wherein the image forming apparatus is a four continuous tandem system.

19. The image forming apparatus according to claim 12, wherein the endless belt is an intermediate transfer conveyer belt or a direct transfer conveyer belt.

20. An image forming apparatus for controlling a driving motor that drives a driving roller based on an output signal from an encoder attached to a driven roller so that an angular velocity of the encoder is kept at a target value, the image forming apparatus comprising:

an endless belt that is driven by the driving roller, the endless belt bearing a mark indicating a reference position and having a thickness of which variation is represented by a function of a phase and a maximum amplitude;

a reference-position detector that detects the reference position by detecting the mark;

an angular-velocity-variation detecting unit that detects a variation in the angular velocity of the encoder due to the variation in the thickness of the endless belt;

a parameter calculating unit that determines the phase at the reference position and the maximum amplitude based on the variation in the angular velocity of the encoder;

a nonvolatile memory that stores the phase at the reference position and the maximum amplitude;

a correction-value calculating unit that calculates a correction value for a position on the endless belt based on a thickness of the endless belt at the position, the thickness being determined by the phase at the reference position and the maximum amplitude;

a volatile memory that stores the correction value calculated; and a target-value calculating unit that reads out the correction value for the current position from the volatile memory based on a distance from the reference position to the current position, and adjusts the target value based on the correction value to compensate for a variation in the output signal from the encoder due to the variation in the thickness of the endless belt.

21. The image forming apparatus according to claim 20, wherein the correction-value calculating unit calculates the correction value at a time of turning on the image forming apparatus or a driving of the endless belt.

22. The image forming apparatus according to claim 20, wherein the function is a sine function.

23. The image forming apparatus according to claim 20, wherein the volatile memory stores a plurality of correction values corresponding to a plurality of positions determined by a predetermined interval.

24. The image forming apparatus according to claim 20, further comprising a correction-value adjusting unit that adjusts the correction value, based on which the target value is adjusted at a start of a control of the driving motor, to zero.

25. The image forming apparatus according to claim 20, wherein the phase and the maximum amplitude to be stored in the nonvolatile memory is input through an operation panel.

26. The image forming apparatus according to 20, wherein the image forming apparatus is a four continuous tandem system.

27. The image forming apparatus according to claim 20, wherein the endless belt is an intermediate transfer conveyer belt or a direct transfer conveyer belt.

* * * * *